US011142853B2

(12) United States Patent
Meir et al.

(10) Patent No.: US 11,142,853 B2
(45) Date of Patent: Oct. 12, 2021

(54) ARTICLE INCORPORATING A LENTICULAR KNIT STRUCTURE

(71) Applicant: NIKE, Inc., Beaverton, OR (US)

(72) Inventors: Adrian Meir, Portland, OR (US); Daniel A. Podhajny, San Jose, CA (US)

(73) Assignee: NIKE, Inc., Beaverton, OR (US)

( * ) Notice: Subject to any disclaimer, the term of this patent is extended or adjusted under 35 U.S.C. 154(b) by 225 days.

(21) Appl. No.: 16/242,747

(22) Filed: Jan. 8, 2019

(65) Prior Publication Data

US 2019/0142102 A1 May 16, 2019

Related U.S. Application Data

(63) Continuation of application No. 15/799,677, filed on Oct. 31, 2017, which is a continuation of application
(Continued)

(51) Int. Cl.
*D04B 1/12* (2006.01)
*A43B 1/04* (2006.01)
*D04B 1/22* (2006.01)

(52) U.S. Cl.
CPC ..... *D04B 1/126* (2013.01); *A43B 1/04* (2013.01); *D04B 1/22* (2013.01);
(Continued)

(58) Field of Classification Search
CPC . D04B 1/126; D04B 1/04; D04B 1/24; D04B 7/26; D04B 1/22; D04B 1/12; A43B 1/04
See application file for complete search history.

(56) References Cited

U.S. PATENT DOCUMENTS 541,916 A 7/1895 Bowman
601,192 A 3/1898 Woodside
(Continued)

FOREIGN PATENT DOCUMENTS

CN 1456724 A 11/2003
CN 201058526 Y 5/2008
(Continued)

OTHER PUBLICATIONS

Declaration of Dr. Edward C. Frederick from US Patent and Trademark Office Inter Partes Review of U.S. Pat. No. 7,347,011 (178 pp).

(Continued)

*Primary Examiner* — Danny Worrell
(74) *Attorney, Agent, or Firm* — Shook, Hardy & Bacon LLP

(57) ABSTRACT

An article of footwear including an upper incorporating a knitted component having color-shifting properties is provided. Color-shift properties can be generated by one or more lenticular knit structures disposed across the upper of the article of footwear. The lenticular knit structures are formed of unitary knit construction with the remaining portions of the knitted component. The lenticular knit structures have portions formed with different yarns. The different yarns on the portions of the lenticular knit structures generate a visual effect that changes the color of the article of footwear depending on the viewing angle.

20 Claims, 22 Drawing Sheets

Related U.S. Application Data

No. 14/734,422, filed on Jun. 9, 2015, now Pat. No. 10,070,679, which is a continuation of application No. 14/535,448, filed on Nov. 7, 2014, now Pat. No. 9,078,488.

(60) Provisional application No. 62/057,264, filed on Sep. 30, 2014, provisional application No. 62/057,293, filed on Sep. 30, 2014.

(52) U.S. Cl.
CPC ..... *D10B 2403/0113* (2013.01); *D10B 2403/02411* (2013.01); *D10B 2501/043* (2013.01)

(56) References Cited

U.S. PATENT DOCUMENTS 951,033 A 3/1910 Sieber
1,215,198 A 2/1917 Rothstein
1,597,934 A 8/1926 Stimpson
1,888,172 A 11/1932 Joha
1,902,780 A 3/1933 Holden et al.
1,910,251 A 5/1933 Joha
2,001,293 A 5/1935 Wilson
2,047,724 A 7/1936 Zuckerman
2,147,197 A 2/1939 Glidden
2,151,879 A 3/1939 Weber
2,314,098 A 3/1943 McDonald
2,330,199 A 9/1943 Basch
2,343,390 A 3/1944 Ushakoff
2,400,692 A 5/1946 Herbert
2,440,393 A 4/1948 Clark
2,569,764 A 10/1951 Jonas
3,015,170 A 1/1952 Kramer
3,016,631 A 1/1952 Servin
2,586,045 A 2/1952 Hoza
2,606,076 A 8/1952 Anderson
2,641,004 A 6/1953 Whiting et al.
2,675,631 A 4/1954 Doughty
2,872,800 A * 2/1959 Davis, Jr. ..... D04B 1/26 66/172 R
2,994,322 A 8/1961 Cullen et al.
3,162,029 A * 12/1964 Laws ..... D04B 1/26 66/172 E
3,264,848 A 8/1966 Pfrommer
3,307,379 A 3/1967 Adams
3,583,081 A 6/1971 Hayashi
3,646,779 A 3/1972 Nuber
3,694,940 A 10/1972 Stohr
3,704,474 A 12/1972 Winkler
3,766,566 A 10/1973 Tadokoro
3,778,856 A 12/1973 Christie et al.
3,798,801 A 3/1974 Gros
3,828,585 A 8/1974 Thorneburg
3,952,427 A 4/1976 Von den Benken et al.
3,972,086 A 8/1976 Belli et al.
4,027,402 A 6/1977 Liu et al.
4,031,586 A 6/1977 Von den Benken et al.
4,211,806 A 7/1980 Civardi et al.
4,232,458 A 11/1980 Bartels
4,255,949 A 3/1981 Thorneburg
4,258,480 A 3/1981 Famolare, Jr.
4,304,108 A * 12/1981 Chamlee ..... D04B 15/80 66/138
4,317,292 A 3/1982 Melton
4,342,801 A 8/1982 Gerlach
4,373,361 A 2/1983 Thorneburg
4,447,967 A 5/1984 Zaino
4,465,448 A 8/1984 Aldridge
4,607,439 A 8/1986 Sogabe et al.
4,630,455 A * 12/1986 Lingenfelter ..... D04B 1/106 2/239
4,737,396 A 4/1988 Kamat
4,750,339 A 6/1988 Simpson et al.
4,756,098 A 7/1988 Boggia
4,785,558 A 11/1988 Shiomura
4,813,158 A 3/1989 Brown
4,838,045 A 6/1989 Cournoyer
4,891,958 A 1/1990 Cournoyer
5,031,423 A 7/1991 Ikenaga
5,095,720 A 3/1992 Tibbals, Jr.
5,117,567 A 6/1992 Berger
5,118,569 A 6/1992 Kuroda
5,152,025 A 10/1992 Hirmas
5,168,729 A 12/1992 Metzner
5,192,601 A 3/1993 Neisler
5,291,671 A 3/1994 Caberlotto et al.
5,307,283 A 4/1994 Sawazaki
5,345,638 A 9/1994 Nishida
5,353,524 A 10/1994 Brier
5,356,701 A 10/1994 Wei
5,371,957 A 12/1994 Gaudio
5,419,161 A 5/1995 Bodenschatz et al.
5,461,884 A 10/1995 McCartney et al.
5,470,625 A 11/1995 Perrault
5,511,323 A 4/1996 Dahlgren
5,572,860 A 11/1996 Mitsumoto et al.
5,575,090 A 11/1996 Condini
5,623,840 A 4/1997 Roell
5,729,918 A 3/1998 Smets
5,735,145 A 4/1998 Pernick
5,746,013 A 5/1998 Fay, Sr.
5,765,296 A 6/1998 Ludemann et al.
5,884,419 A 3/1999 Davidowitz et al.
5,890,381 A 4/1999 Leeke
5,992,057 A 11/1999 Monti
5,996,189 A 12/1999 Wang
6,006,550 A 12/1999 Singh
6,029,376 A 2/2000 Cass
6,032,387 A 3/2000 Johnson
6,052,921 A 4/2000 Oreck
6,073,468 A 6/2000 Wallace
6,082,147 A 7/2000 Rock
6,088,936 A 7/2000 Bahl
6,105,401 A 8/2000 Chadeyron
6,112,437 A 9/2000 Lovitt
6,151,802 A 11/2000 Reynolds
6,164,095 A 12/2000 Rock et al.
6,170,175 B1 1/2001 Funk
6,308,438 B1 10/2001 Throneburg
6,333,105 B1 12/2001 Tanaka et al.
6,397,638 B1 6/2002 Roell
6,401,364 B1 6/2002 Burt
6,412,196 B1 7/2002 Gross
6,558,784 B1 5/2003 Norton et al.
6,588,237 B2 7/2003 Cole et al.
6,745,395 B2 6/2004 Noble
6,754,983 B2 6/2004 Hatfield et al.
6,829,912 B2 12/2004 Rempp
6,837,078 B1 1/2005 Rock
6,910,288 B2 6/2005 Dua
6,922,917 B2 8/2005 Kerns et al.
6,931,762 B1 8/2005 Dua
D517,297 S 3/2006 Jones et al.
7,051,460 B2 5/2006 Orei et al.
7,056,402 B2 6/2006 Koerwien et al.
7,155,846 B2 1/2007 Alfaro
7,174,750 B2 2/2007 Shirasaki
7,235,504 B2 6/2007 Shirasaki
7,293,371 B2 11/2007 Aveni
7,347,011 B2 3/2008 Dua et al.
7,388,421 B1 6/2008 Liu
7,441,348 B1 10/2008 Dawson
7,543,397 B2 6/2009 Kilgore et al.
7,565,821 B2 7/2009 Park
7,568,298 B2 8/2009 Kerns
7,682,219 B2 3/2010 Falla
7,774,956 B2 8/2010 Dua
8,448,474 B1 5/2013 Tatler et al.
8,490,299 B2 7/2013 Dua et al.
8,522,577 B2 9/2013 Huffa
8,631,589 B2 1/2014 Dojan

(56) References Cited

U.S. PATENT DOCUMENTS

| | | | |
|---|---|---|---|
| 8,839,532 | B2 | 9/2014 | Huffa et al. |
| 8,959,959 | B1 | 2/2015 | Podhajny |
| 8,973,410 | B1 | 3/2015 | Podhajny |
| 8,997,530 | B1 | 4/2015 | Podhajny |
| 9,027,260 | B2 | 5/2015 | Dua |
| 9,078,488 | B1 | 7/2015 | Meir et al. |
| 9,192,204 | B1 | 11/2015 | Liles et al. |
| 9,375,046 | B2 | 6/2016 | Meir |
| 9,404,205 | B2 | 8/2016 | Meir |
| 9,681,704 | B2 | 6/2017 | Podhajny et al. |
| 9,826,798 | B2 | 11/2017 | Liles et al. |
| 10,070,679 | B2 | 9/2018 | Meir et al. |
| 2002/0078599 | A1 | 6/2002 | Delgorgue et al. |
| 2002/0148258 | A1 | 10/2002 | Cole et al. |
| 2003/0126762 | A1 | 7/2003 | Tseng |
| 2003/0191427 | A1 | 10/2003 | Jay et al. |
| 2004/0118018 | A1 | 6/2004 | Dua |
| 2004/0181972 | A1 | 9/2004 | Csorba |
| 2005/0115284 | A1 | 6/2005 | Dua |
| 2005/0126042 | A1 | 6/2005 | Baier et al. |
| 2005/0136768 | A1 | 6/2005 | Huang |
| 2005/0160770 | A1 | 7/2005 | Ikeda |
| 2005/0193592 | A1 | 9/2005 | Dua et al. |
| 2005/0268497 | A1 | 12/2005 | Alfaro et al. |
| 2005/0273988 | A1 | 12/2005 | Christy |
| 2005/0284000 | A1 | 12/2005 | Kerns |
| 2006/0059715 | A1 | 3/2006 | Aveni |
| 2006/0130359 | A1 | 6/2006 | Dua et al. |
| 2006/0162187 | A1 | 7/2006 | Byrnes et al. |
| 2007/0016999 | A1 | 1/2007 | Harber et al. |
| 2007/0022627 | A1 | 2/2007 | Sokolowski et al. |
| 2007/0068047 | A1 | 3/2007 | Alfaro et al. |
| 2007/0101612 | A1 | 5/2007 | Kilgore |
| 2007/0180730 | A1 | 8/2007 | Greene et al. |
| 2007/0294920 | A1 | 12/2007 | Baychar |
| 2008/0017294 | A1 | 1/2008 | Bailey et al. |
| 2008/0078102 | A1 | 4/2008 | Kilgore et al. |
| 2008/0110048 | A1 | 5/2008 | Dua et al. |
| 2008/0110049 | A1 | 5/2008 | Sokolowski |
| 2008/0189830 | A1 | 8/2008 | Egglesfield |
| 2008/0313939 | A1 | 12/2008 | Ardill |
| 2009/0068908 | A1 | 3/2009 | Hinchcliff |
| 2010/0043253 | A1 | 2/2010 | Dojan |
| 2010/0051132 | A1 | 3/2010 | Glenn |
| 2010/0154256 | A1 | 6/2010 | Dua |
| 2010/0170651 | A1 | 7/2010 | Scherb et al. |
| 2010/0175276 | A1 | 7/2010 | Dojan |
| 2010/0251491 | A1 | 10/2010 | Dojan |
| 2010/0251564 | A1 | 10/2010 | Meschter |
| 2011/0030244 | A1 | 2/2011 | Motawi et al. |
| 2011/0041359 | A1 | 2/2011 | Dojan |
| 2011/0078921 | A1 | 4/2011 | Greene et al. |
| 2011/0277352 | A1 | 11/2011 | Diepenbrock |
| 2012/0180340 | A1 | 7/2012 | Crowley, II |
| 2012/0222189 | A1 | 9/2012 | Sokolowski et al. |
| 2012/0233882 | A1 | 9/2012 | Huffa et al. |
| 2012/0234052 | A1 | 9/2012 | Huffa et al. |
| 2012/0246973 | A1 | 10/2012 | Dua |
| 2012/0255201 | A1 | 10/2012 | Little |
| 2012/0284935 | A1 | 11/2012 | Dojan et al. |
| 2013/0019500 | A1 | 1/2013 | Greene |
| 2013/0145652 | A1 | 6/2013 | Podhajny et al. |
| 2013/0239625 | A1 | 9/2013 | Tatler et al. |
| 2013/0318837 | A1 | 12/2013 | Dua et al. |
| 2014/0068968 | A1 | 3/2014 | Podhajny et al. |
| 2014/0150292 | A1 | 6/2014 | Podhajny et al. |
| 2014/0196311 | A1 | 7/2014 | Follet et al. |
| 2014/0196316 | A1 | 7/2014 | Follet |
| 2014/0237861 | A1 | 8/2014 | Podhajny |
| 2014/0245632 | A1 | 9/2014 | Podhajny et al. |
| 2014/0245633 | A1 | 9/2014 | Podhajny |
| 2014/0245634 | A1 | 9/2014 | Podhajny |
| 2014/0245638 | A1 | 9/2014 | Seamarks et al. |
| 2014/0310984 | A1 | 10/2014 | Tamm |
| 2014/0338226 | A1 | 11/2014 | Zavala |
| 2015/0047225 | A1 | 2/2015 | Zavala et al. |
| 2015/0059209 | A1 | 3/2015 | Dekovic et al. |
| 2015/0250256 | A1 | 9/2015 | Podhajny |
| 2016/0029736 | A1 | 2/2016 | Meir |
| 2016/0058098 | A1 | 3/2016 | Cross et al. |
| 2016/0088899 | A1 | 3/2016 | Liles et al. |
| 2016/0090670 | A1 | 3/2016 | Meir |
| 2016/0108566 | A1 | 4/2016 | Tseng et al. |
| 2016/0340812 | A1 | 11/2016 | Meir |
| 2018/0064211 | A1 | 3/2018 | Henrichot et al. |
| 2018/0179676 | A1 | 6/2018 | Takahashi |
| 2019/0142101 | A1 | 5/2019 | Meir et al. |
| 2019/0226129 | A1 | 7/2019 | Meir |
| 2020/0077745 | A1 | 3/2020 | Henrichot et al. |

FOREIGN PATENT DOCUMENTS

| | | | |
|---|---|---|---|
| CN | 202536202 | U | 11/2012 |
| CN | 202950101 | U | 5/2013 |
| CN | 103462296 | A | 12/2013 |
| CN | 103844428 | A | 6/2014 |
| CN | 205030620 | U | 2/2016 |
| DE | 870963 | | 3/1953 |
| DE | 1084173 | | 6/1960 |
| DE | 19738433 | | 4/1998 |
| DE | 19728846 | | 1/1999 |
| EP | 0279950 | | 8/1988 |
| EP | 372370 | | 6/1990 |
| EP | 0448714 | | 10/1991 |
| EP | 0728860 | | 8/1996 |
| EP | 0758693 | | 2/1997 |
| EP | 0898002 | | 2/1999 |
| EP | 1233091 | | 8/2002 |
| EP | 1437057 | | 7/2004 |
| EP | 1563752 | | 8/2005 |
| EP | 1602762 | | 12/2005 |
| EP | 1972706 | | 9/2008 |
| EP | 2716177 | | 4/2014 |
| FR | 2171172 | | 9/1973 |
| FR | 2571387 | | 4/1986 |
| GB | 538865 | | 8/1941 |
| GB | 1461928 | | 1/1977 |
| GB | 2018837 | | 10/1979 |
| GB | 1603487 | | 11/1981 |
| JP | 53-120541 | | 6/1951 |
| JP | 38-17917 | A | 8/1988 |
| JP | H06113905 | | 4/1994 |
| JP | 7-49614 | A | 2/1995 |
| JP | H08109553 | | 4/1996 |
| JP | H10-298847 | | 11/1998 |
| JP | H11302943 | | 11/1999 |
| JP | 2000-502934 | A | 3/2000 |
| KR | 10-2011-0038679 | A | 4/2011 |
| NL | 7304678 | | 10/1974 |
| TW | 162299 | | 7/1991 |
| TW | 503275 | B | 9/2002 |
| TW | 723400 | B | 4/2021 |
| WO | WO90/03744 | | 4/1990 |
| WO | WO00/32861 | | 6/2000 |
| WO | WO 02/04726 | A1 | 1/2002 |
| WO | WO02/31247 | | 4/2002 |
| WO | 2010/014300 | A1 | 2/2010 |
| WO | WO 2013/113339 | A1 | 8/2013 |
| WO | 2014/134244 | A1 | 9/2014 |

OTHER PUBLICATIONS

David J. Spencer, Knitting Technology: A Comprehensive Handbook and Pratical Guide (Third ed., Wodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

International Search Report and Written Opinion in connection with PCT/US2009/056795 dated Apr. 20, 2010.

International Search Report and Written Opinion in connection with PCT/US2012/028576 dated Oct. 1, 2012.

(56) References Cited

OTHER PUBLICATIONS

International Search Report and Written Opinion in connection with PCT/US2012/0285559 dated Oct. 19, 2012.
International Search Report and Written Opinion in connection with PCT/US2012/028534 dated Oct. 17, 2012.
International Preliminary Report on Patentability in connection with PCT/US2012/028534 dated Sep. 17, 2013.
International Preliminary Report on Patentability in connection with PCT/US2012/028576 dated Sep. 17, 2013.
Internaitonal Search Report and Written Opinion of the International Searching Authority dated Dec. 15, 2015 for PCT/US2015/052434 (13 pp.).
International Search Report and Written Opinion of the International Searching Authority dated Jan. 29, 2016 for PCT/US2015/052453 (15 pp.).
International Search Report and Written Opinion of the International Search Authority dated Jan. 22, 2016 for PCT/US2015/052426 (13 pp.).
U.S. Appl. No. 14/535,413, filed Nov. 7, 2014.
Office Action, and English language translation thereof, in corresponding Chinese Application No. 201520827315.3, dated Mar. 1, 2016, 4 pages.
International Preliminary Report on Patentability in corresponding International Application No. PCT/US2015/052453, dated Apr. 13, 2017, 12 pages.
International Preliminary Report on Patentability in corresponding International Application No. PCT/US2015/052426, dated Apr. 4, 2017, 10 pages.
Office Action, and English language translation thereof, in corresponding Chinese Application No. 201510191848.1, dated Aug. 29, 2017, 14 pages.
Office Action, and English language translation thereof, in Chinese Application No. 201510192547.0, dated Sep. 1, 2017, 10 pages.
Non-Final Office Action in U.S. Appl. No. 14/734,422, and Form 892 references, dated Feb. 23, 2017, 12 pages.
Non-Final Office Action in U.S. Appl. No. 15/799,677, and Form 892 references, dated Dec. 2, 2019, 10 pages.
Exhibit/Paper No. 1002, date filed May 3, 2019, in PTAB IPR No. 2019-01060, 39 page(s).
Exhibit/Paper No. 1003 (Part 1), date filed May 3, 2019, in PTAB IPR No. 2019-01060, 664 page(s).
Exhibit/Paper No. 1003 (Part 2), date filed May 3, 2019, in PTAB IPR No. 2019-01060, 675 page(s).
Exhibit/Paper No. 1004, date filed May 3, 2019, in PTAB IPR No. 2019-01060, 27 page(s).
Exhibit/Paper No. 1006, date filed May 3, 2019, in PTAB IPR No. 2019-01060, 16 page(s).
Exhibit/Paper No. 1007, date filed May 3, 2019, in PTAB IPR No. 2019-01060, 90 page(s).
Exhibit/Paper No. 1010, date filed May 3, 2019, in PTAB IPR No. 2019-01060, 4 page(s).
Exhibit/Paper No. 1011, date filed May 3, 2019, in PTAB IPR No. 2019-01060, 1 page(s).
Exhibit/Paper No. 1, date filed May 3, 2019, in PTAB IPR No. 2019-01060, 81 page(s).
Exhibit/Paper No. 2, date filed May 3, 2019, in PTAB IPR No. 2019-01060, 5 page(s).
Exhibit/Paper No. 1001, date filed May 3, 2019, in PTAB IPR No. 2019-01060, 39 page(s).
Exhibit/Paper No. 1005, date filed May 3, 2019, in PTAB IPR No. 2019-01060, 4 page(s).
Exhibit/Paper No. 1008, date filed May 3, 2019, in PTAB IPR No. 2019-01060, 3 page(s).
Exhibit/Paper No. 1009, date filed May 3, 2019, in PTAB IPR No. 2019-01060, 1 page(s).
Exhibit/Paper No. 3, date filed May 23, 2019, in PTAB IPR No. 2019-01060, 4 page(s).
Exhibit/Paper No. 4, date filed May 23, 2019, in PTAB IPR No. 2019-01060, 4 page(s).
Exhibit/Paper No. 6, date filed Jun. 14, 2019, in PTAB IPR No. 2019-01060, 5 page(s).
Exhibit/Paper No. 7, date filed Sep. 5, 2019, in PTAB IPR No. 2019-01060, 69 page(s).
Exhibit/Paper No. 2004, date filed Sep. 5, 2019, in PTAB IPR No. 2019-01060, 4 page(s).
Exhibit/Paper No. 2006, date filed Sep. 5, 2019, in PTAB IPR No. 2019-01060, 7 page(s).
Exhibit/Paper No. 2007, date filed Sep. 5, 2019, in PTAB IPR No. 2019-01060, 2 page(s).
Exhibit/Paper No. 2009, date filed Sep. 5, 2019, in PTAB IPR No. 2019-01060, 65 page(s).
Exhibit/Paper No. 2012, date filed Sep. 5, 2019, in PTAB IPR No. 2019-01060, 2 page(s).
Exhibit/Paper No. 2013, date filed Sep. 5, 2019, in PTAB IPR No. 2019-01060, 10 page(s).
Exhibit/Paper No. 2014, date filed Sep. 5, 2019, in PTAB IPR No. 2019-01060, 12 page(s).
Exhibit/Paper No. 2001, date filed Sep. 5, 2019, in PTAB IPR No. 2019-01060, 47 page(s).
Exhibit/Paper No. 2002, date filed Sep. 5, 2019, in PTAB IPR No. 2019-01060, 2 page(s).
Exhibit/Paper No. 2003, date filed Sep. 5, 2019, in PTAB IPR No. 2019-01060, 8 page(s).
Exhibit/Paper No. 2005, date filed Sep. 5, 2019, in PTAB IPR No. 2019-01060, 43 page(s).
Exhibit/Paper No. 2008, date filed Sep. 5, 2019, in PTAB IPR No. 2019-01060, 14 page(s).
Exhibit/Paper No. 2010, date filed Sep. 5, 2019, in PTAB IPR No. 2019-01060, 42 page(s).
Exhibit/Paper No. 2011, date filed Sep. 5, 2019, in PTAB IPR No. 2019-01060, 2 page(s).
Exhibit/Paper No. 8, date filed Dec. 2, 2019, in PTAB IPR No. 2019-01060, 8 page(s).
Exhibit/Paper No. 10, date filed Dec. 2, 2019, in PTAB IPR No. 2019-01060, 4 page(s).
Exhibit/Paper No. 12, date filed, Dec. 4, 2019, in PTAB IPR No. 2019-01060, 4 page(s).
Exhibit/Paper No. 5, date filed Jun. 5, 2019_, in PTAB IPR No. 2019-01060, 5 page(s).
Exhibit/Paper No. 11, date filed Dec. 3, 2019, in PTAB IPR No. 2019-01060, 4 page(s).
Exhibit/Paper No. 13, date filed Dec. 6, 2019, in PTAB IPR No. 2019-01060, 2 page(s).
Exhibit/Paper No. 1001, date filed Jun. 11, 2019, in PTAB IPR No. 2019-01190, 39 page(s).
Exhibit/Paper No. 1002, date filed Jun. 11, 2019, in PTAB IPR No. 2019-01190, 39 page(s).
Exhibit/Paper No. 1003 (Part 1), date filed Jun. 11, 2019, in PTAB IPR No. 2019-01190, 664 page(s).
Exhibit/Paper No. 1003 (Part 2), date filed Jun. 11, 2019, in PTAB IPR No. 2019-01190, 675 page(s).
Exhibit/Paper No. 1006, date filed Jun. 11, 2019, in PTAB IPR No. 2019-01190, 16 page(s).
Exhibit/Paper No. 1008, date filed Jun. 11, 2019, in PTAB IPR No. 2019-01190, 3 page(s).
Exhibit/Paper No. 1011, date filed Jun. 11, 2019, in PTAB IPR No. 2019-01190, 1 page(s).
Exhibit/Paper No. 2, date filed Jun. 11, 2019, in PTAB IPR No. 2019-01190, 5 page(s).
Exhibit/Paper No. 1, date filed Jun. 11, 2019, in PTAB IPR No. 2019-01190, 39 page(s).
Exhibit/Paper No. 1004, date filed Jun. 11, 2019, in PTAB IPR No. 2019-01190, 27 page(s).
Exhibit/Paper No. 1005, date filed Jun. 11, 2019, in PTAB IPR No. 2019-01190, 4 page(s).
Exhibit/Paper No. 1007, date filed Jun. 11, 2019, in PTAB IPR No. 2019-01190, 90 page(s).
Exhibit/Paper No. 1009 date filed Jun. 11, 2019, in PTAB IPR No. 2019-01190, 1 page(s).
Exhibit/Paper No. 1010, date filed Jun. 11, 2019, in PTAB IPR No. 2019-01190, 4 page(s).

(56) References Cited

OTHER PUBLICATIONS

Exhibit/Paper No. 3, date filed Jun. 14, 2019, in PTAB IPR No. 2019-01190, 5 page(s).
Exhibit/Paper No. 4, date filed Jun. 14, 2019, in PTAB IPR No. 2019-01190, 4 page(s).
Exhibit/Paper No. 2001, date filed Sep. 19, 2019, in PTAB IPR No. 2019-01190, 26 page(s).
Exhibit/Paper No. 2006, date filed Sep. 19, 2019, in PTAB IPR No. 2019-01190, 7 page(s).
Exhibit/Paper No. 2008, date filed Sep. 19, 2019, in PTAB IPR No. 2019-01190, 14 page(s).
Exhibit/Paper No. 2010, date filed Sep. 19, 2019, in PTAB IPR No. 2019-01190, 42 page(s).
Exhibit/Paper No. 6, date filed Sep. 19, 2019, in PTAB IPR No. 2019-01190, 36 page(s).
Exhibit/Paper No. 2002, date filed Sep. 19, 2019, in PTAB IPR No. 2019-01190, 2 page(s).
Exhibit/Paper No. 2003, date filed Sep. 19, 2019, in PTAB IPR No. 2019-01190, 8 page(s).
Exhibit/Paper No. 2004, date filed Sep. 19, 2019, in PTAB IPR No. 2019-01190, 4 page(s).
Exhibit/Paper No. 2005, date filed Sep. 19, 2019, in PTAB IPR No. 2019-01190, 43 page(s).
Exhibit/Paper No. 2007, date filed Sep. 19, 2019, in PTAB IPR No. 2019-01190, 2 page(s).
Exhibit/Paper No. 2009, date filed Sep. 19, 2019, in PTAB IPR No. 2019-01190, 33 page(s).
Exhibit/Paper No. 2011, date filed Sep. 19, 2019, in PTAB IPR No. 2019-01190, 2 page(s).
Exhibit/Paper No. 2012, date filed Sep. 19, 2019, in PTAB IPR No. 2019-01190, 2 page(s).
Exhibit/Paper No. 2013, date filed Sep. 19, 2019, in PTAB IPR No. 2019-01190, 10 page(s).
Exhibit/Paper No. 2014, date filed Sep. 19, 2019, in PTAB IPR No. 2019-01190, 12 page(s).
Exhibit/Paper No. 7, date filed Dec. 2, 2019, in PTAb IPR No. 2019-01190, 8 page(s).
Exhibit/Paper No. 9, date filed Dec. 2, 2019, in PTAB IPR No. 2019-01190, 4 page(s).
Exhibit/Paper No. 11, date filed Dec. 4, 2019, in PTAB IPR No. 2019-01190, 4 page(s).
Exhibit/Paper No. 5, date filed Jun. 19, 2019, in PTAB IPR No. 2019-01190, 5 page(s).
Exhibit/Paper No. 10, date filed Dec. 3, 2019, in PTAB IPR No. 2019-01190, 4 page(s).
Exhibit/Paper No. 12, date filed Dec. 6, 2019, in PTAB IPR No. 2019-01190, 2 page(s).
Non-Final Office action received for U.S. Appl. No. 16/686,413, dated Jun. 18, 2021, 8 pages.
Office Action received for European Patent Application No. 15775585.1, dated May 25, 2021, 5 pages.
Office Action received for European Patent Application No. 15782125.7, dated Jun. 1, 2021, 5 pages.
Examination Report received in corresponding Indian Application No. 201747010912, dated Sep. 18, 2020, 3 pages.
Extended European Search Report received for European Patent Application No. 20169478.3,, dated Nov. 11, 2020, 8 pages.
Final Office Action received for U.S. Appl. No. 14/880,707, dated Feb. 27, 2017, 8 pages.
Final Office Action received for U.S. Appl. No. 15/799,677, dated Jun. 9, 2020, 10 pages.
Final Written Decision received for U.S. Pat. No. 9,375,046 by the Patent Trial and Appeal Board, dated Dec. 3, 2019, IPR2019-01059 (U.S. Pat. No. 9,375,046 B2), IPR2019-01060 (U.S. Pat. No. 9,078,488 B1), IPR2019-01190 (U.S. Pat. No. 10,070,679 B1), IPR2019-01342 (U.S. Pat. No. 10,098,411 B2), *Puma North America, Inc.*, Petitioner, v. *Nike, Inc*, Patent Owner., 4 pages.
International Preliminary Search Report on Patentability received for PCT Patent Application No. PCT/US2015/052434, dated Apr. 13, 2017, 9 pages.
Non-Final Office Action received for U.S. Appl. No. 14/535,413, dated Jul. 20, 2015, 13 pages.
Non-Final Office Action received for U.S. Appl. No. 14/535,648, dated Mar. 31, 2015, 5 pages.
Non-Final Office Action received for U.S. Appl. No. 14/686,975, dated Sep. 24, 2015, 10 pages.
Non-Final Office Action received for U.S. Appl. No. 14/880,707, dated Oct. 13, 2016, 7 pages.
Non-Final Office Action received for U.S. Appl. No. 15/225,516, dated Aug. 29, 2018, 9 pages.
Non-Final Office Action received for U.S. Appl. No. 15/588,253, dated Nov. 14, 2019, 10 pages.
Non-Final Office Action received for U.S. Appl. No. 15/807,116, dated Apr. 2, 2019, 6 pages.
Non-Final Office Action received for U.S. Appl. No. 16/374,201, dated Jul. 8, 2020, 9 pages.
Notice of Allowance received for U.S. Appl. No. 14/535,413, dated Feb. 25, 2016, 5 pages.
Notice of Allowance received for U.S. Appl. No. 14/535,448, dated Mar. 13, 2015, 6 pages.
Notice of Allowance received for U.S. Appl. No. 14/535,648, dated Jul. 10, 2015, 5 pages.
Notice of Allowance received for U.S. Appl. No. 14/686,975, dated Mar. 30, 2016, 5 pages.
Notice of Allowance received for U.S. Appl. No. 14/734,422, dated Jul. 21, 2017, 5 pages.
Notice of Allowance received for U.S. Appl. No. 14/880,707, dated Jul. 28, 2017, 5 pages.
Notice of Allowance received for U.S. Appl. No. 15/225,516, dated Dec. 11, 2018, 5 pages.
Notice of Allowance received for U.S. Appl. No. 15/588,253, dated Jul. 8, 2020, 5 pages.
Notice of Allowance received for U.S. Appl. No. 15/588,253, dated Mar. 9, 2020, 5 pages.
Notice of Allowance received for U.S. Appl. No. 15/799,677, dated Sep. 18, 2020, 5 pages.
Notice of Allowance received for U.S. Appl. No. 15/807,116, dated Jul. 17, 2019, 5 pages.
Notice of Allowance received for U.S. Appl. No. 16/374,201, dated Feb. 3, 2021, 5 pages.
Office Action received for Indian Patent Application No. 201747010360, dated Feb. 20, 2020, 7 pages.
Office Action received for Indian Patent Application No. 201747010674, dated Feb. 20, 2020, 8 pages.
Non-Final Office action received for U.S. Appl. No. 16/242,723, dated Jun. 25, 2021, 8 pages.

* cited by examiner

ARTICLE INCORPORATING A LENTICULAR KNIT STRUCTURE

CROSS-REFERENCE TO RELATED APPLICATIONS

This application a continuation of U.S. patent application Ser. No. 15/799,677, filed Oct. 31, 2017 and entitled "Article of Footwear Incorporating a Lenticular Knit Structure," which is a continuation of U.S. patent application Ser. No. 14/734,422, filed Jun. 9, 2015 and entitled "Article of Footwear Incorporating a Lenticular Knit Structure", which is a continuation of U.S. patent application Ser. No. 14/535,448, filed on Nov. 7, 2014 and entitled "Article of Footwear Incorporating a Lenticular Knit Structure", which non-provisional patent application claims the benefit of priority under 35 U.S.C. § 119(e) to U.S. Provisional Patent Application Ser. No. 62/057,264, which was filed in the U.S. Patent and Trademark Office on Sep. 30, 2014 and entitled "Article of Footwear Incorporating A Knitted Component with Inlaid Tensile Elements and Method of Assembly", and which non-provisional patent application also claims the benefit of priority under 35 U.S.C. § 119(e) to U.S. Provisional Patent Application Ser. No. 62/057,293, which was filed in the U.S. Patent and Trademark Office on Sep. 30, 2014 and entitled "Article of Footwear Incorporating a Lenticular Knit Structure", the disclosures of which applications listed in this paragraph are each entirely incorporated herein by reference.

BACKGROUND

The present invention relates generally to articles of footwear, and, in particular, to articles of footwear incorporating knitted components.

Conventional articles of footwear generally include two primary elements, an upper and a sole structure. The upper is secured to the sole structure and forms a void on the interior of the footwear for comfortably and securely receiving a foot. The sole structure is secured to a lower area of the upper, thereby being positioned between the upper and the ground. In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

The upper generally extends over the instep and toe areas of the foot, along the medial and lateral sides of the foot, under the foot, and around the heel area of the foot. In some articles of footwear, such as basketball footwear and boots, the upper may extend upward and around the ankle to provide support or protection for the ankle. Access to the void on the interior of the upper is generally provided by an ankle opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

A variety of material elements (e.g., textiles, polymer foam, polymer sheets, leather, synthetic leather) are conventionally utilized in manufacturing the upper. In athletic footwear, for example, the upper may have multiple layers that each include a variety of joined material elements. As examples, the material elements may be selected to impart stretch-resistance, wear-resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in a layered configuration to impart multiple properties to the same areas. As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and numbers of material elements. By decreasing the number of material elements utilized in the upper, therefore, waste may be decreased while increasing the manufacturing efficiency and recyclability of the upper.

SUMMARY

Various configurations of an article of footwear may have an upper and a sole structure secured to the upper. The upper may incorporate a knitted component. A knitted component may include color-shifting properties generated by one or more lenticular knit structures disposed across the upper of the article of footwear. The lenticular knit structures are formed of unitary knit construction with the remaining portions of the knitted component.

In one aspect, the invention provides an article of footwear including an upper and a sole structure attached to the upper. The upper incorporates a knitted component formed of unitary knit construction. The knitted component comprising at least one lenticular knit structure including a first portion and a second portion disposed on opposite sides of the lenticular knit structure. The knitted component further comprising a base portion disposed adjacent to the at least one lenticular knit structure. The at least one lenticular knit structure extends away from the base portion on an exterior surface of the upper. The first portion of the at least one lenticular knit structure is associated with a first visual effect when the upper is viewed from a first viewing angle and the second portion of the at least one lenticular knit structure is associated with a second visual effect when the upper is viewed from a second viewing angle that is different than the first viewing angle.

In another aspect, the invention provides a knitted component for incorporating into an article. The knitted component comprises a plurality of lenticular knit structures. Each of the lenticular knit structures include a first portion formed using a first yarn on one side of the lenticular knit structure and a second portion formed using a second yarn disposed on an opposite side of the lenticular knit structure.

The first yarn and the second yarn are different. The knitted component further comprises a base portion disposed between adjacent lenticular knit structures. The first portion, the second portion, and the base portion are formed of unitary knit construction with the knitted component. The first portion of the lenticular knit structure is associated with a first visual effect when the knitted component is viewed from a first viewing angle and the second portion of the at least one lenticular knit structure is associated with a second visual effect when the knitted component is viewed from a second viewing angle that is different than the first viewing angle.

In another aspect, the invention provides a method of manufacturing a knitted component for incorporating into an article. The method comprises knitting a base portion of the knitted component, knitting a first portion of a lenticular knit structure using a first yarn, and knitting a second portion of the lenticular knit structure using a second yarn. The second yarn is different from the first yarn. The lenticular knit structure being formed so that the first portion and the second portion are disposed on opposite sides of the lenticular knit structure and the lenticular knit structure extends away from the base portion in a vertical direction. The first portion of the lenticular knit structure is associated with a first visual effect when the knitted component is viewed from a first viewing angle and the second portion of the at least one lenticular knit structure is associated with a second visual effect when the knitted component is viewed from a second viewing angle that is different than the first viewing angle.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
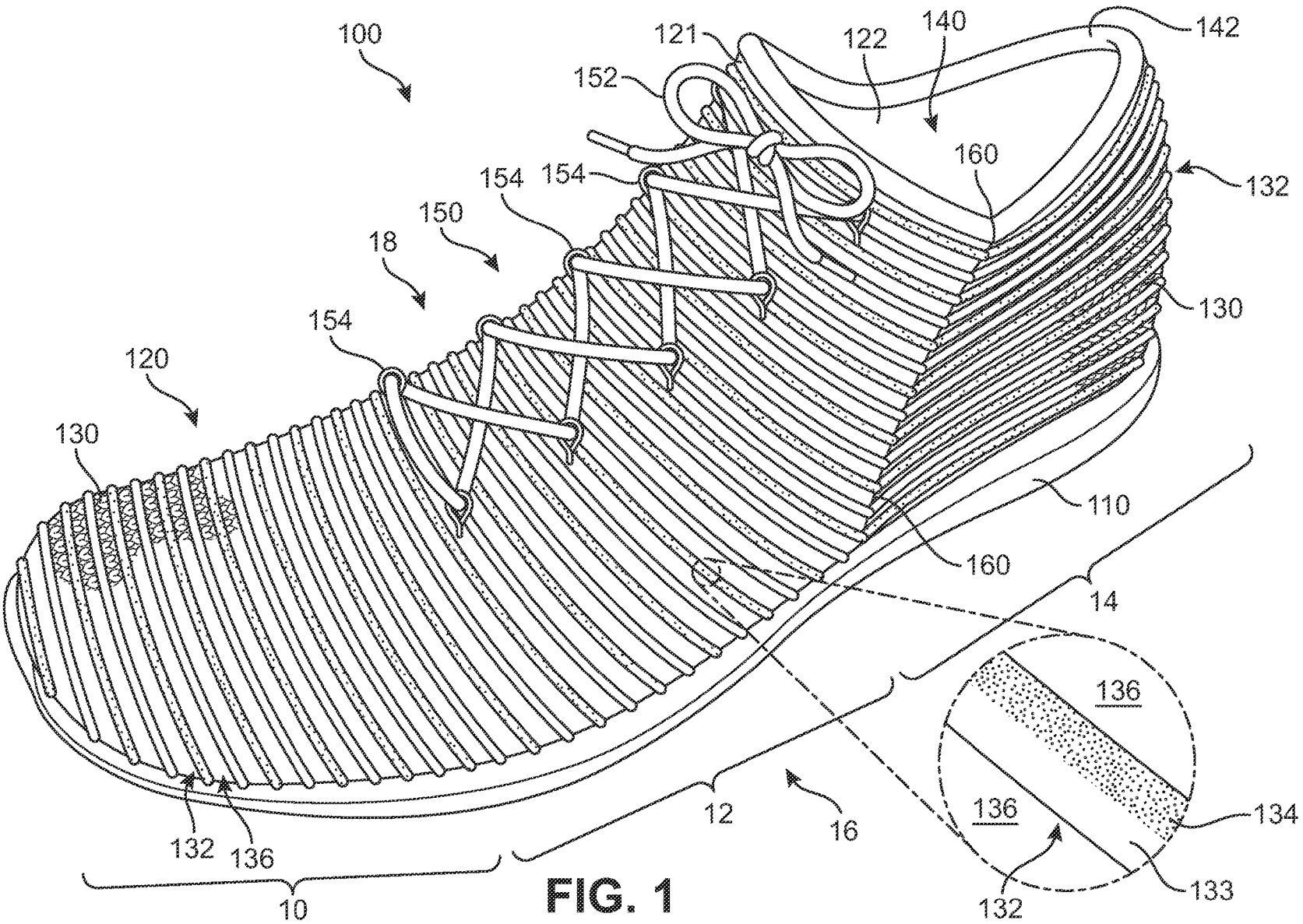
FIG. 1 is an isometric view of an exemplary embodiment of an article of footwear incorporating a knitted component having lenticular knit structures.

The following discussion and accompanying figures disclose a variety of concepts relating to knitted components and the manufacture of knitted components. Although the knitted components may be used in a variety of products, an article of footwear that incorporates one or more of the knitted components is disclosed below as an example. In addition to footwear, the knitted component may be used in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted component may also be used in bed coverings (e.g., sheets, blankets), table coverings, towels, flags, tents, sails, and parachutes. The knitted component may be used as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted component and other concepts disclosed herein may be incorporated into a variety of products for both personal and industrial purposes.

FIGS. 1 through 22 illustrate exemplary embodiments of an article of footwear having an upper incorporating a knitted component including lenticular knit structures and the associated method of manufacturing. The upper incorporates a knitted component including one or more lenticular knit structures that provide color-shifting properties to the upper and the article of footwear. The individual features of any of the knitted components described herein may be used in combination or may be provided separately in different configurations for articles of footwear. In addition, any of the features may be optional and may not be included in any one particular embodiment of a knitted component.

For consistency and convenience, directional adjectives are employed throughout this detailed description corresponding to the illustrated embodiments. The term "longitudinal" as used throughout this detailed description and in the claims refers to a direction extending a length or major axis of an article. In some cases, the longitudinal direction may extend from a forefoot region to a heel region of the article. Also, the term "lateral" as used throughout this detailed description and in the claims refers to a direction extending a width or minor axis of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, including an upper, a knitted component and portions thereof, and/or a sole structure.

FIGS. 1 through 6 illustrate an exemplary embodiment of an article of footwear 100, also referred to simply as article 100. In some embodiments, article of footwear 100 may include a sole structure 110 and an upper 120. Although article 100 is illustrated as having a general configuration suitable for running, concepts associated with article 100 may also be applied to a variety of other athletic footwear types, including soccer shoes, baseball shoes, basketball shoes, cycling shoes, football shoes, tennis shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to article 100 may be applied to a wide variety of footwear types.

Figure 2:
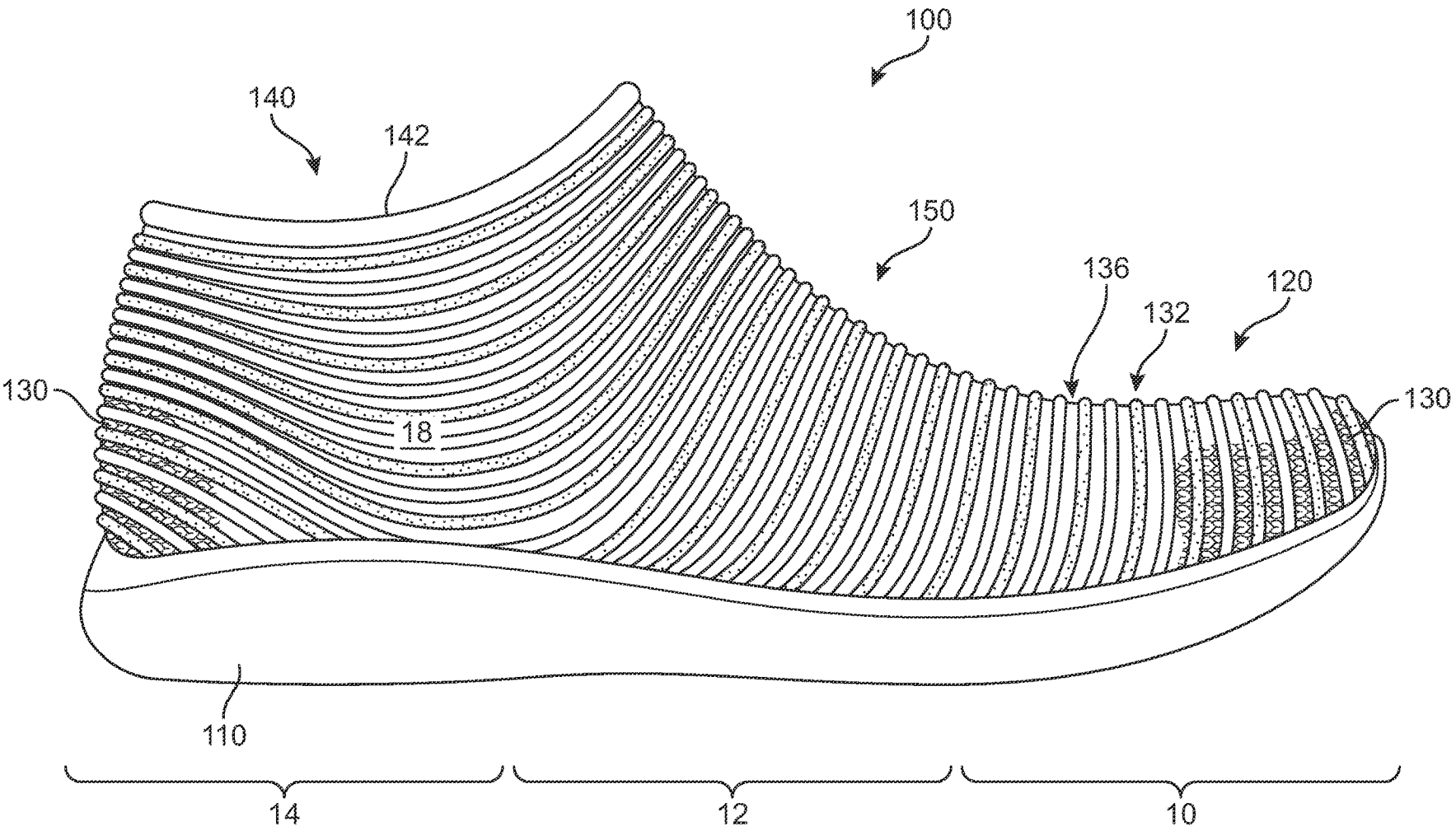
FIG. 2 is a medial side view of the exemplary embodiment of an article of footwear incorporating a knitted component having lenticular knit structures.
Figure 3:
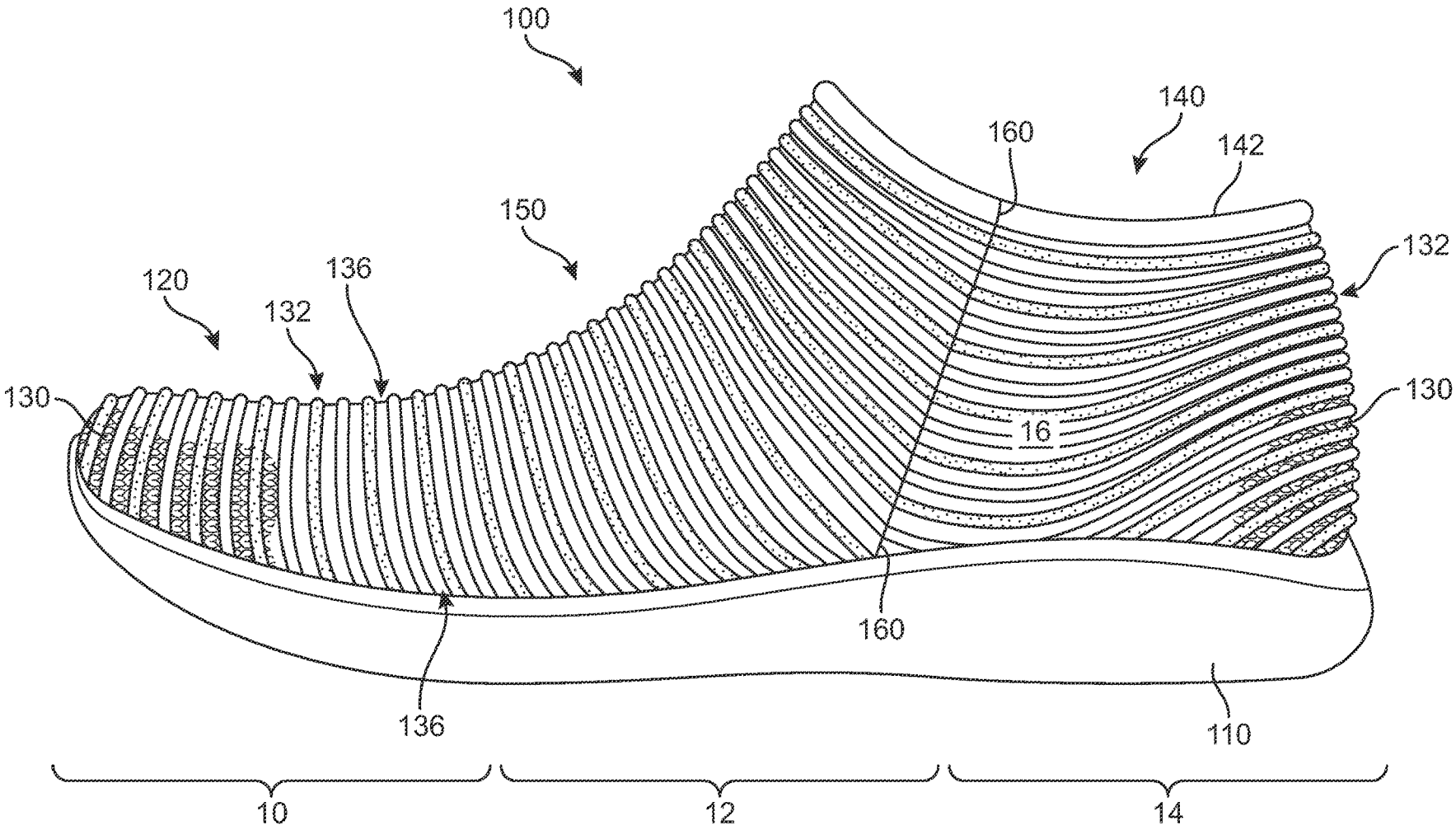
FIG. 3 is a lateral side view of the exemplary embodiment of an article of footwear incorporating a knitted component having lenticular knit structures.

For reference purposes, article 100 may be divided into three general regions: a forefoot region 10, a midfoot region 12, and a heel region 14, as generally shown in FIGS. 1, 2, and 3. Forefoot region 10 generally includes portions of article 100 corresponding with the toes and the joints connecting the metatarsals with the phalanges. Midfoot region 12 generally includes portions of article 100 corresponding with an arch area of the foot. Heel region 14 generally corresponds with rear portions of the foot, including the calcaneus bone. Article 100 also includes a lateral side 16 and a medial side 18, which extend through each of forefoot region 10, midfoot region 12, and heel region 14 and correspond with opposite sides of article 100. More particularly, lateral side 16 corresponds with an outside area of the foot (i.e., the surface that faces away from the other foot), and medial side 18 corresponds with an inside area of the foot (i.e., the surface that faces toward the other foot). Forefoot region 10, midfoot region 12, and heel region 14 and lateral side 16, medial side 18 are not intended to demarcate precise areas of article 100. Rather, forefoot region 10, midfoot region 12, and heel region 14 and lateral side 16, medial side 18 are intended to represent general areas of article 100 to aid in the following discussion. In addition to article 100, forefoot region 10, midfoot region 12, and heel region 14 and lateral side 16, medial side 18 may also be applied to sole structure 110, upper 120, and individual elements thereof.

Figure 4:
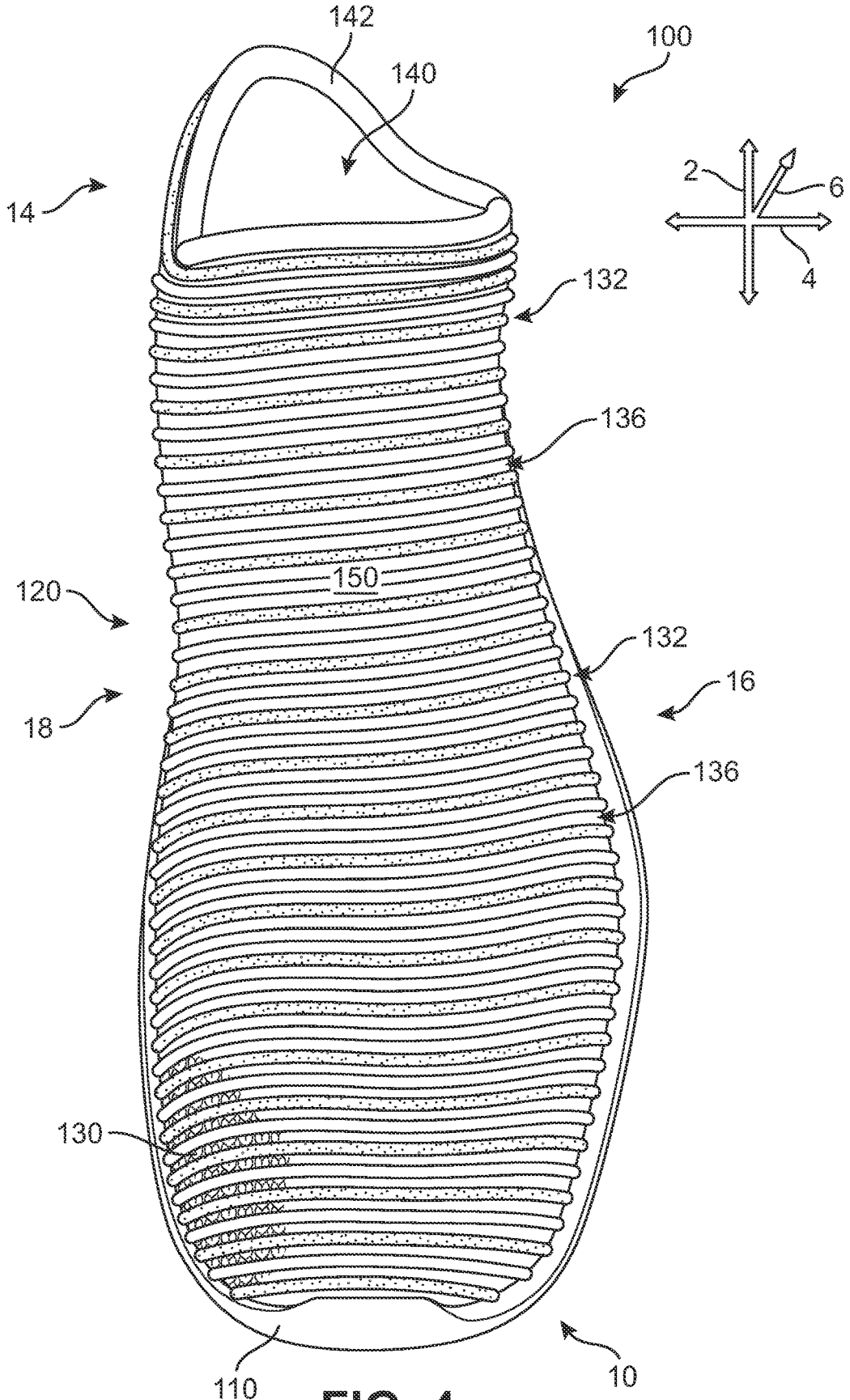
FIG. 4 is a top front view of the exemplary embodiment of an article of footwear incorporating a knitted component having lenticular knit structures.

An exemplary coordinate system for describing the embodiment of article 100 shown in FIGS. 1 through 15 is illustrated in FIG. 4, where a longitudinal direction 2 extends along article 100 between forefoot region 10 to heel region 14 of article 100, a lateral direction 4 extends along article 100 between lateral side 16 and medial side 18, and a vertical direction 6 extends along article 100 between sole structure 110 and a top of article 100.

In an exemplary embodiment, sole structure 110 is secured to upper 120 and extends between the foot and the ground when article 100 is worn. In some embodiments, sole structure 110 may include one or more components, including a midsole, an outsole, and/or a sockliner or insole. In an exemplary embodiment, sole structure 110 may include an outsole that is secured to a lower surface of upper 120 and/or a base portion configured for securing sole structure 110 to upper 120. In one embodiment, outsole may be formed from a wear-resistant rubber material that is textured to impart traction. Although this configuration for sole structure 110 provides an example of a sole structure that may be used in connection with upper 120, a variety of other conventional or nonconventional configurations for sole structure 110 may also be used. Accordingly, in other embodiments, the features of sole structure 110 or any sole structure used with upper 120 may vary.

For example, in other embodiments, sole structure 110 may include a midsole and/or a sockliner. A midsole may be secured to a lower surface of an upper and in some cases may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other cases, a midsole may incorporate plates, moderators, fluid-filled chambers, lasting elements, or motion control members that further attenuate forces, enhance stability, or influence the motions of the foot. In still other cases, the midsole may be primarily formed from a fluid-filled chamber that is located within an upper and is positioned to extend under a lower surface of the foot to enhance the comfort of an article.

In some embodiments, upper 120 defines a void within article 100 for receiving and securing a foot relative to sole structure 110. The void is shaped to accommodate the foot and extends along a lateral side of the foot, along a medial side of the foot, over the foot, around the heel, and under the foot. Upper 120 includes an exterior surface 121 and an opposite interior surface 122. Whereas the exterior surface faces outward and away from article 100, the interior surface faces inward and defines a majority or a relatively large portion of the void within article 100 for receiving the foot. Moreover, the interior surface may lay against the foot or a sock covering the foot. Upper 120 may also include a collar 142 that is located in at least heel region 14 and forms a throat opening 140. Access to the void is provided by throat opening 140. More particularly, the foot may be inserted into upper 120 through throat opening 140 formed by collar 142, and the foot may be withdrawn from upper 120 through throat opening 140 formed by collar 142. In some embodiments, an instep area 150 extends forward from collar 142 and throat opening 140 in heel region 14 over an area corresponding to an instep of the foot in midfoot region 12 to an area adjacent to forefoot region 10.

In some embodiments, upper 120 may include a throat portion disposed between lateral side 16 and medial side 18 of upper 120 through instep area 150. In an exemplary embodiment, the throat portion may be integrally attached to and formed of unitary knit construction with portions of upper 120 along lateral and medial sides through instep area 150. Accordingly, as shown in the Figures, upper 120 may extend substantially continuously across instep area 150 between lateral side 16 and medial side 18. In other embodiments, the throat portion may be disconnected along lateral and medial sides through instep area 150 such that the throat portion is moveable within an opening between a lateral portion and a medial portion on opposite sides of instep area 150, thereby forming a tongue.

In some embodiments, a lace 152 extends through a plurality of lace receiving members 154 in upper 120 and permits the wearer to modify dimensions of upper 120 to accommodate proportions of the foot. In some embodiments, lace 152 may extend through lace receiving members 154 that are disposed along either side of instep area 150. More particularly, lace 152 permits the wearer to tighten upper 120 around the foot, and lace 152 permits the wearer to loosen upper 120 to facilitate entry and removal of the foot from the void (i.e., through throat opening 140). In addition, the throat portion of upper 120 in instep area 150 extends under lace 152 to enhance the comfort of article 100. Lace 152 is illustrated with article 100 in FIG. 1, while in the remaining Figures, lace 152 has been omitted for purposes of clarity. In further configurations, upper 120 may include additional elements, such as (a) a heel counter in heel region 14 that enhances stability, (b) a toe guard in forefoot region 10 that is formed of a wear-resistant material, and (c) logos, trademarks, and placards with care instructions and material information.

Many conventional footwear uppers are formed from multiple material elements (e.g., textiles, polymer foam, polymer sheets, leather, synthetic leather) that are joined through stitching or bonding, for example. In contrast, in some embodiments, a majority of upper 120 is formed from a knitted component 130, which will be discussed in more detail below. Knitted component 130 may, for example, be manufactured through a flat knitting process and extends through each of forefoot region 10, midfoot region 12, and heel region 14, along both lateral side 16 and medial side 18, over forefoot region 10, and around heel region 14. In an exemplary embodiment, knitted component 130 forms substantially all of upper 120, including exterior surface 121 and a majority or a relatively large portion of interior surface 122, thereby defining a portion of the void within upper 120. In some embodiments, knitted component 130 may also extend under the foot. In other embodiments, however, a strobel sock or thin sole-shaped piece of material is secured to knitted component 130 to form an attachment portion of upper 120 that extends under the foot for attachment with sole structure 110.

In addition, in this embodiment, a seam 160 extends substantially vertically along lateral side 16 from collar 142 in a downwards direction towards sole structure 110 to join edges of knitted component 130. In other embodiments, seam 160 may be disposed in a substantially similar manner on medial side 18. In still other embodiments, seam 160 may instead extend vertically through heel region 14 from collar 142 in downwards direction towards sole structure 110 at the rear of article 100.

Although seams may be present in knitted component 130, a majority of knitted component 130 has a substantially seamless configuration. Moreover, knitted component 130 may be formed of unitary knit construction. As utilized herein, a knitted component (e.g., knitted component 130) is defined as being formed of "unitary knit construction" when formed as a one-piece element through a knitting process. That is, the knitting process substantially forms the various features and structures of knitted component 130 without the need for significant additional manufacturing steps or processes. A unitary knit construction may be used to form a knitted component having structures or elements that include one or more courses of yarn, strands, or other knit material that are joined such that the structures or elements include at least one course in common (i.e., sharing a common yarn) and/or include courses that are substantially continuous between each of the structures or elements. With this arrangement, a one-piece element of unitary knit construction is provided.

Although portions of knitted component 130 may be joined to each other (e.g., edges of knitted component 130 being joined together) following the knitting process, knitted component 130 remains formed of unitary knit construction because it is formed as a one-piece knit element. Moreover, knitted component 130 remains formed of unitary knit construction when other elements (e.g., a lace, logos, trademarks, placards with care instructions and material information, structural elements) are added following the knitting process.

In different embodiments, any suitable knitting process may be used to produce knitted component 130 formed of unitary knit construction, including, but not limited to a warp knitting or a weft knitting process, including a flat knitting process or a circular knitting process, or any other knitting process suitable for providing a knitted component. Examples of various configurations of knitted components and methods for forming knitted component 130 with unitary knit construction are disclosed in one or more of U.S. Pat. No. 6,931,762 to Dua; U.S. Pat. No. 7,347,011 to Dua, et al.; U.S. Pat. No. 8,490,299 to Dua et al.; and U.S. Pat. No. 8,839,532 to Huffa et al., the disclosures of which are incorporated by reference in their entirety. In an exemplary embodiment, a flat knitting process may be used to form knitted component 130, as will be described in more detail.

In various embodiments, an article of footwear may be provided with an upper incorporating a knitted component with color-shifting properties. In general, color-shifting properties refer to the characteristic of an element to appear different colors depending on the viewing angle of the element. In an exemplary embodiment, color-shifting properties may be provided to an article of footwear using a visual effect similar to or inspired by lenticular printing techniques. Lenticular printing includes the use of lenses to cause a shift in the visible image or pattern when viewed from different viewing angles. This technique of lenticular printing can be used to create simple animations and visual effects for advertising and other purposes.

In some embodiments, a knitted component may be provided with color-shifting properties through the use of a lenticular knit structure. A lenticular knit structure is configured to present at least two different colors to a viewer when the lenticular knit structure is viewed from different viewing angles. For example, when viewed from a first viewing angle, a lenticular knit structure may cause the knitted component to appear a first color, but when viewed from a second viewing angle that is different than the first viewing angle, the lenticular knit structure causes the knitted component to appear a second color that is different from the first color. With this configuration, the lenticular knit structure may alter the visual color appearance of the knitted component as the knitted component and/or the viewer moves relative to the article of footwear. The change in the viewing angle associated with such movement of the knitted component and/or the viewer causes the lenticular knit structure to present different colors to the viewer, thereby generating color-shifting properties to the knitted component and the article of footwear.

In an exemplary embodiment, at least a portion of knitted component 130 may be provided with color-shifting properties through incorporation of one or more lenticular knit structures 132. In this embodiment, lenticular knit structure 132 may be in the form of a tubular rib structure. In some cases, tubular rib structures can be non-planar structures extending away from the surface of knitted component 130 and defining hollow tubes formed in knitted component 130 by co-extensive and overlapping knit layers that are closed to form the tube. In other cases, tubular rib structures may include additional components that are disposed within the tubes, as will be described in more detail below.

In some embodiments, at least a portion of knitted component 130 may include areas extending between lenticular knit structures 132, i.e., located between the adjacent tubular rib structures forming lenticular knit structures 132, on exterior surface 121 of knitted component. In an exemplary embodiment, a base portion 136 of knitted component 130 is disposed between lenticular knit structures 132. In some cases, base portion 136 can be flexible, elastic, and resilient and assist with stretching of knitted component 130.

The properties that a particular type of yarn will impart to an area of knitted component 130 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is a durable and abrasion-resistant material with relatively high strength. Polyester is a hydrophobic material that also provides relatively high durability. In addition to materials, other aspects of the yarns selected for knitted component 130 may affect the properties of upper 120. For example, a yarn forming knitted component 130 may include separate filaments that are each formed of different materials. In addition, the yarn may include filaments that are each formed of two or more different materials, such as a bicomponent yarn with filaments having a sheath-core configuration or two halves formed of different materials. Different degrees of twist and crimping, as well as different deniers, may also affect the properties of upper 120. Accordingly, both the materials forming the yarn and other aspects of the yarn may be selected to impart a variety of properties to separate areas of upper 120.

In some configurations of knitted component 130, materials forming yarns may be non-fusible or fusible. For example, a non-fusible yarn may be substantially formed from a thermoset polyester material and fusible yarn may be at least partially formed from a thermoplastic polyester material. When a fusible yarn is heated and fused to non-fusible yarns, this process may have the effect of stiffening or rigidifying the structure of knitted component 130. Moreover, joining portions of non-fusible yarn using fusible yarns may have the effect of securing or locking the relative positions of non-fusible yarns within knitted component 130, thereby imparting stretch-resistance and stiffness. That is, portions of non-fusible yarn may not slide relative to each other when fused with the fusible yarn, thereby preventing warping or permanent stretching of knitted component 130 due to relative movement of the knit structure. Another feature of using fusible yarns in portions of knitted component 130 relates to limiting unraveling if a portion of knitted component 130 becomes damaged or one of the non-fusible yarns is severed. Accordingly, areas of knitted component 130 may be configured with both fusible and non-fusible yarns within the knit structure.

In an exemplary embodiment, lenticular knit structures 132 may provide color-shifting properties to knitted component 130 through incorporation of two or more types of yarn being used to knit the lenticular knit structure 132. For example, in embodiments where lenticular knit structure 132 is in the form of a tubular rib structure, different portions of the lenticular knit structure 132 may include different types of yarn along each side of the tubular rib structure. In one embodiment, a first portion 133 of lenticular knit structure 132 disposed on one side of the tubular rib structure may be knit using a first yarn and a second portion 134 of lenticular knit structure 132 disposed on the opposite side of the tubular rib structure may be knit using a second yarn that is different from the first yarn. In some cases, the types of yarn may vary in color to provide the color-shifting properties to knitted component 130. In other cases, the types of yarn may vary in texture or denier to provide the color-shifting properties to knitted component 130.

Referring to FIG. 1, in this embodiment, knitted component 130 includes a plurality of lenticular knit structures 132 in the form of tubular rib structures that extend approximately along the lateral direction between lateral side 16 and medial side 18 through forefoot region 10, midfoot region 12, and a portion of heel region 14. Each lenticular knit structure 132 includes first portion 133 disposed on one side of the tubular rib structure facing towards forefoot region 10 at the front of article 100 and second portion 134 disposed on the opposite side of the tubular rib structure facing towards heel region 14 at the back or rear of article 100. With this configuration, the color-shifting properties of knitted component 130 caused by lenticular knit structures 132 may vary as article 100 is viewed from different viewing angles.

In addition, in an exemplary embodiment, at least a portion of knitted component 130 may include lenticular knit structures 132 that have a different orientation. For example, in an area of knitted component 130 disposed near heel region 14 on lateral side 16 and medial side 18, lenticular knit structures 132 transition from being oriented approximately along the lateral direction to being oriented approximately along the longitudinal direction. Medial side 18 may be seen with particular reference to medial side view shown in shown in FIG. 2 and lateral side 16 may be seen with particular reference to lateral side view shown in FIG. 3. As a result of this varying orientation, lenticular knit structures 132 in these areas may include first portion 133 disposed on one side of the tubular rib structure facing vertically downwards towards sole structure 110 at the bottom of article 100 and second portion 134 disposed on the opposite side of the tubular rib structure facing vertically upwards towards collar 142 and throat opening 140 at the top of article 100. With this configuration, the color-shifting properties of knitted component 130 caused by lenticular knit structures 132 may vary as article 100 is viewed from different viewing angles.

Additionally, because of the different orientation of lenticular knit structures 132 disposed approximately along the longitudinal direction, the viewing angles from which the color-shifting properties are visible may be different than the viewing angles for the lenticular knit structures 132 disposed approximately along the lateral direction. With this configuration, different areas of knitted component 130 and article 100 may have color-shifting properties across various viewing angles, such that as article 100 and/or the viewer move relative to each other, the different areas of knitted component 130 appear to color-shift separately or at different times during movement.

Figure 5:
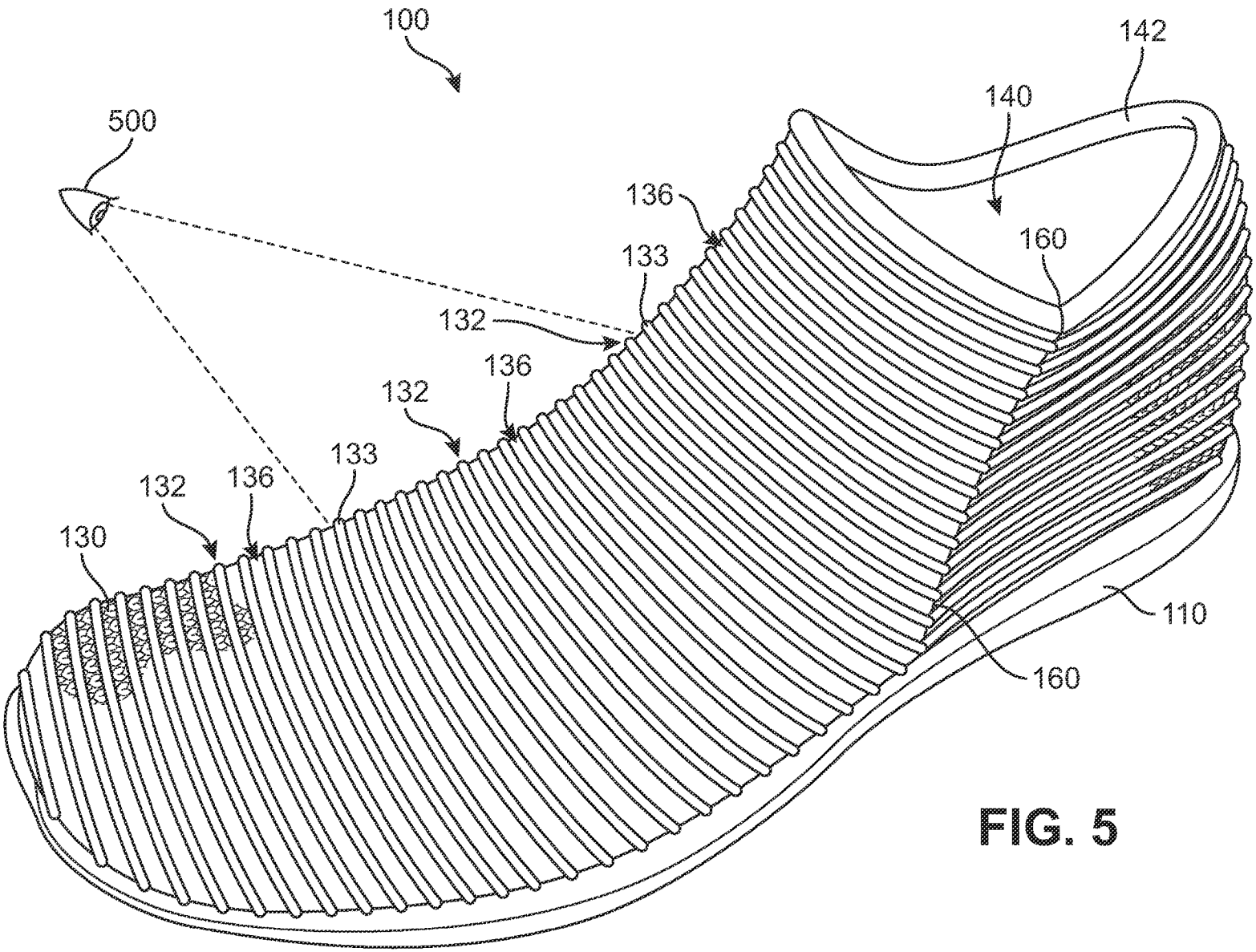
FIG. 5 is a representational view of the exemplary embodiment of an article of footwear a knitted component having lenticular knit structures viewed from a first viewing angle.
Figure 6:
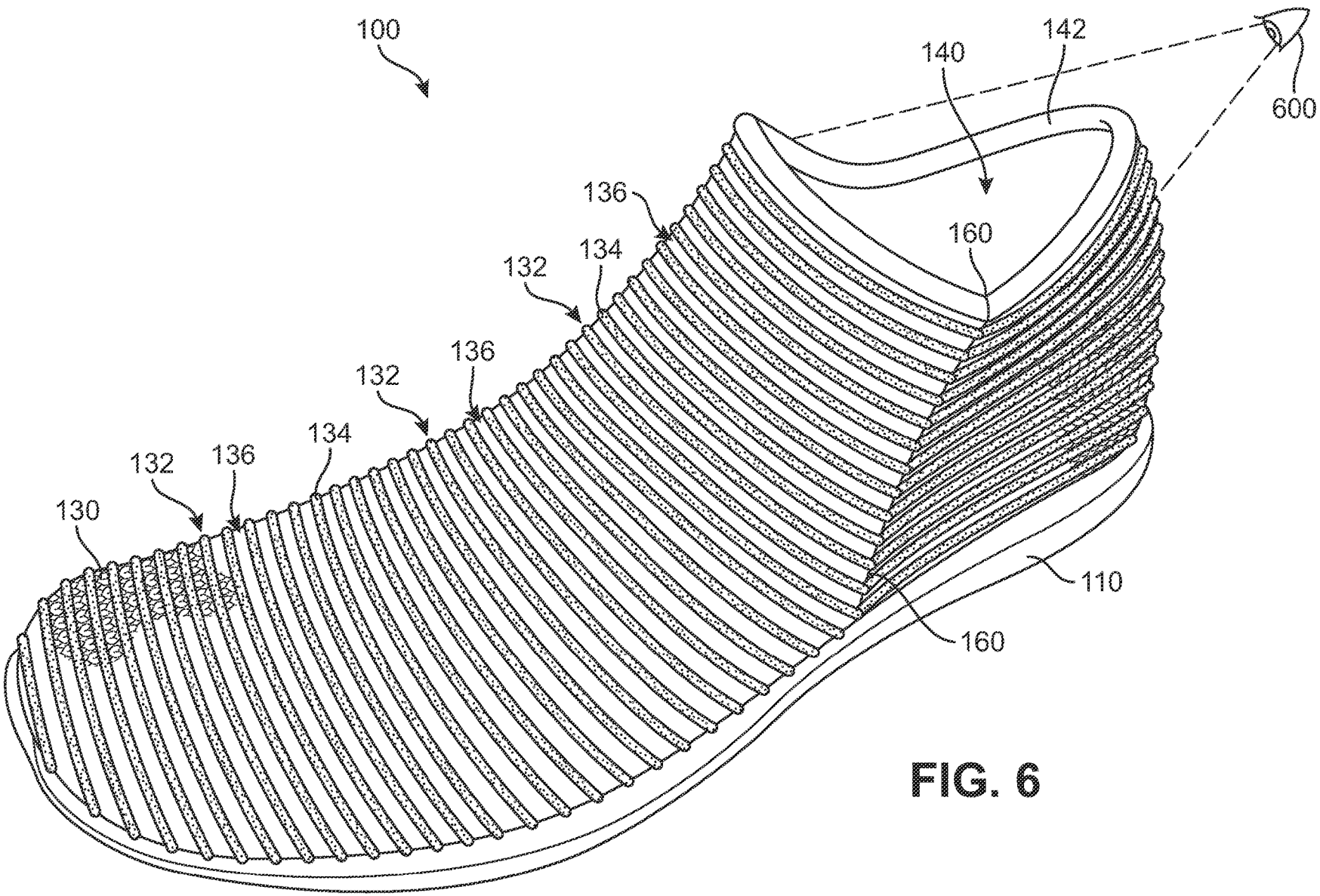
FIG. 6 is a representational view of the exemplary embodiment of an article of footwear a knitted component having lenticular knit structures viewed from a second viewing angle.

FIGS. 5 and 6 illustrate two representational views of the color-shifting properties of knitted component 130 caused by lenticular knit structures 132 when article 100 is viewed from two different viewing angles. In this embodiment, knitted component 130 includes lenticular knit structures 132 that have first portion 133 formed using a first yarn and second portion 134 formed using a second yarn. As noted above, in various embodiments, the first yarn and the second yarn may be different types that provide different visual effects. For example, in this embodiment, the first yarn may be associated with a first color and the second yarn may be associated with a second color that is different from the first. In other embodiments, however, the first yarn and the second yarn may be of types having different characteristics that may cause a visual color-shifting effect.

Referring now to FIG. 5, in this embodiment, article 100 is being viewed by a viewer from a first viewing angle 500. First viewing angle 500 is disposed approximately in front of article 100 and is oriented at least partially along the longitudinal direction of article 100. From first viewing angle 500, article 100 presents knitted component 130 appearing to have a first color. In an exemplary embodiment, the first color is the same as the first yarn used to knit first portion 133 of lenticular knit structures 132. That is, from first viewing angle 500, first portion 133 of each lenticular knit structure 132 is aligned so as to be facing towards the viewer. With this orientation, the first yarn used to form first portion 133 of lenticular knit structure 132 is visible from first viewing angle 500, while the second yarn used to form second portion 134 of lenticular knit structure 132 is disposed on the opposite side and shielded from being viewed from first viewing angle 500. In this case, the properties of the first yarn forming first portion 133 of lenticular knit structure 132 (i.e., the type, color, texture, denier, etc.) are primarily responsible for the visual effect to knitted component 130 to cause it to appear the first color from first viewing angle 500.

Referring now to FIG. 6, in this embodiment, article 100 is being viewed by a viewer from a second viewing angle 600. Second viewing angle 600 is different than first viewing angle 500 shown in FIG. 5 and may be oriented at least partially along the longitudinal direction of article 100 disposed approximately behind article 100. From second viewing angle 600, article 100 presents knitted component 130 appearing to have a second color that is different from the first color appearing to the viewer from first viewing angle 500. In an exemplary embodiment, the second color is the same as the second yarn used to knit second portion 134 of lenticular knit structures 132. That is, from second viewing angle 600, second portion 134 of each lenticular knit structure 132 is aligned so as to be facing towards the viewer. With this orientation, the second yarn used to form second portion 134 of lenticular knit structure 132 is visible from second viewing angle 600, while the first yarn used to form first portion 133 of lenticular knit structure 132 that was visible from first viewing angle 500 is now disposed on the opposite side and shielded from being viewed from second viewing angle 600. In this case, the properties of the second yarn forming second portion 134 of lenticular knit structure 132 (i.e., the type, color, texture, denier, etc.) are primarily responsible for the visual effect to knitted component 130 to cause it to appear the second color from second viewing angle 600. With this configuration, color-shifting properties of knitted component 130 may be provided by lenticular knit structure 132.

Additionally, in some embodiments, base portion 136 of knitted component 130 may be visible from each of first viewing angle 500 and second viewing angle 600. Base portion 136 may be formed using a yarn type, including yarn color, that is substantially similar to either of the first yarn or the second yarn forming first portion 133 or second portion 134 of lenticular knit structure 132. With this configuration, the type of yarn used to form base portion 136 may further assist with providing the visual effect of the first color or the second color to knitted component 130 from first viewing angle 500 or second viewing angle 600. In other embodiments, however, base portion 136 may be formed using a different yarn type, including a different yarn color, from either of the first yarn or the second yarn forming first portion 133 or second portion 134 of lenticular knit structure 132. With this configuration, base portion 136 may provide a contrasting visual effect from either of the first color or the second color.

In still other embodiments, lenticular knit structures 132 may be closely spaced so that base portion 136 is not initially partially or wholly visible from either of first viewing angle 500 or second viewing angle 600. Upon stretching of knitted component 130, however, base portion 136 may be revealed from between adjacent lenticular knit structures 132. Accordingly, in these embodiments, base portion 136 may be formed using a yarn type, including yarn color, that is highly contrasting from either yarn type or color of the first yarn or the second yarn forming first portion 133 or second portion 134 of lenticular knit structure 132. For example, in one embodiment, base portion 136 may be formed using a yarn with reflective or retroreflective properties.

Knitted component 130 can be manufactured with the configurations described above using any suitable machine, implement, and technique. For example, in some embodiments, knitted component 130 can be automatically manufactured using a knitting machine, such as the knitting machine 700 shown in FIG. 7. Knitting machine 700 can be of any suitable type, such as a flat knitting machine. However, it will be appreciated that knitting machine 700 could be of another type in different embodiments without departing from the scope of the present disclosure.

Figure 7:
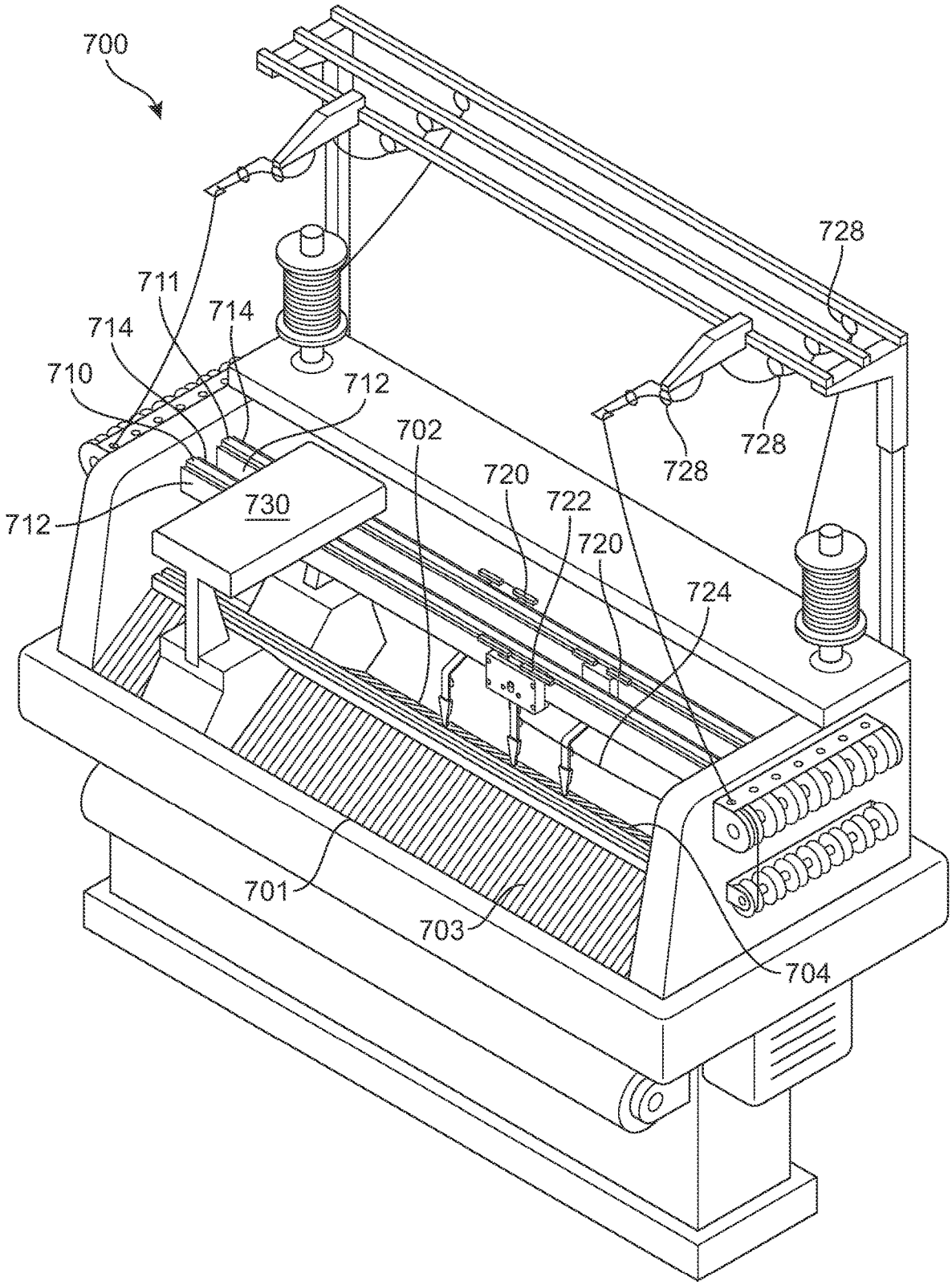
FIG. 7 is a schematic perspective view of an embodiment of a knitting machine configured for manufacturing the knitted component.

As shown in the embodiment of FIG. 7, knitting machine 700 can include a front needle bed 701 with a plurality of front needles 703 and a rear needle bed 702 with a plurality of rear needles 704. Front needles 703 can be arranged in a common plane, and rear needles 704 can be arranged in a different common plane that intersects the plane of front needles 703. Front needle bed 701 and rear needle bed 702 may be angled with respect to each other. In some embodiments, front needle bed 701 and rear needle bed 702 may be angled so they form a V-bed. Knitting machine 700 can further include one or more feeders that are configured to move over front needle bed 701 and rear needle bed 702. In FIG. 7, a first type of feeder 720 and a second type of feeder 722 are indicated. Knitting machine 700 further includes a carriage 730 that moves across the needle beds and assists with moving the feeders relative to the needle beds. In this embodiment, knitting machine 700 is illustrated with a plurality of first type of feeder 720 and at least one of second type of feeder 722. As first type of feeder 720 moves, feeder 720 can deliver yarn to front needles 703 and/or rear needles 704 for one or more of knitting, tucking, or floating using the yarn to form a knitted component, including knitted component 130. As second type of feeder 722 moves, second type of feeder 722 can deliver a yarn to front needles 703 and/or rear needles 704 for one or more of knitting, tucking, or floating. In some embodiments, second type of feeder 722 may be a combination feeder that may additionally be configured to inlay a yarn. In an exemplary embodiment, second type of feeder 722 may deliver a tensile element 724 to be inlaid within knitted component 130.

A pair of rails, including a forward rail 710 and a rear rail 711, may extend above and parallel to the intersection of front needle bed 701 and rear needle bed 702. Rails may provide attachment points for feeders. Forward rail 710 and rear rail 711 may each have two sides, including a front side 712 and a back side 714. Each of front side 712 and back side 714 can accommodate one or more feeders. As depicted, rear rail 711 includes two of feeders 720 on opposite sides, and forward rail 710 includes feeder 722. Although two rails are depicted, further configurations of knitting machine 700 may incorporate additional rails to provide attachment points for more feeders.

Feeders can move along forward rail 710 and rear rail 711, thereby supplying yarns to needles. As shown in FIG. 7, yarns are provided to a feeder by one or spools that route yarns through yarn guides 728 to the feeders for knitting. Although not depicted, additional spools may be used to provide yarns to feeders in a substantially similar manner. A suitable knitting machine including conventional and combination feeders for knitting machine 700, as well as the associated method of knitting using the machine to form knitted components, is described in U.S. Pat. No. 8,522,577 to Huffa, the disclosure of which is incorporated by reference in its entirety.

Figure 8:
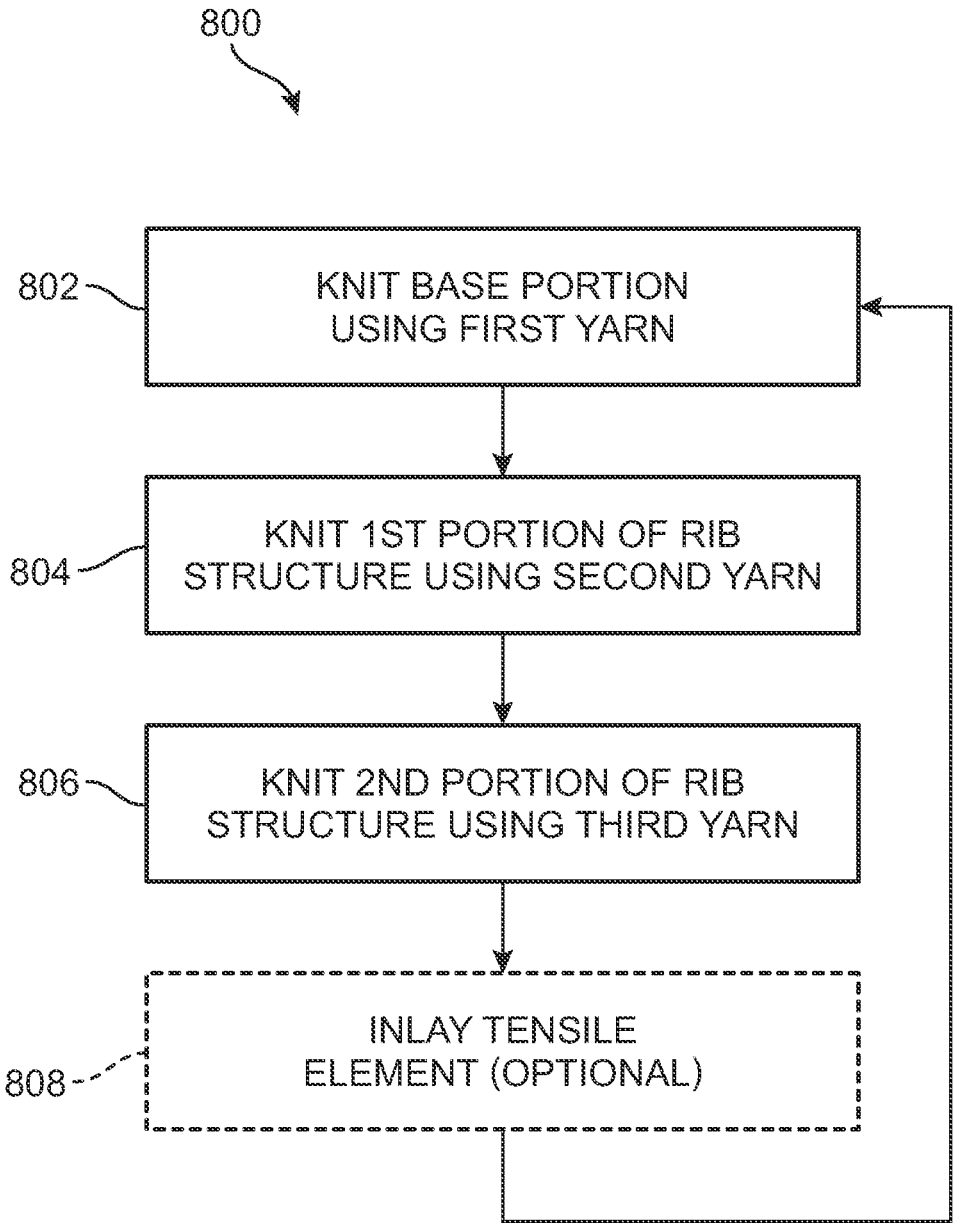
FIG. 8 is a flowchart of an exemplary process of knitting a lenticular knit structure.

FIG. 8 illustrates an exemplary process 800 of knitting a knitted component to include a lenticular knit structure, including knitted component 130 having lenticular knit structure 132. In one embodiment, process 800 may include one or more steps that may be repeated to form a completed knitted component. The order of the steps is exemplary, and in other embodiments, additional or different steps not shown in FIG. 8 may be included to knit a knitted component. At a first step 802, base portion 136 of knitted component 130 may be knit using a first yarn. Next, at step 804, first portion 133 of the tubular rib structure forming lenticular knit structure 132 may be knit using a second yarn. At a step 806, second portion 134 of the tubular rib structure forming lenticular knit structure 132 may be knit using a third yarn. As noted above, in exemplary embodiments, the second yarn used at step 804 and the third yarn used at step 806 may be different types of yarn, including yarns having different characteristics, including, but not limited to: color, texture, denier, or other qualities, to provide the color-shifting properties to knitted component 130 caused by lenticular knit structure 132.

In some embodiments, the first yarn used at step 802 to form base portion 136 may be different from one or both of the second yarn and the third yarn. In other embodiments, the first yarn used at step 802 may be similar to either of the second yarn and the third yarn.

In some embodiments, tensile elements 724 can be incorporated, inlaid, or extended into one or more tubular rib structures during the unitary knit construction of the knitted component 130. Stated another way, tensile elements 724 can be incorporated during knitting process 800 of knitted component 130. As shown in FIG. 8, process 800 may include an optional step 808 to inlay a tensile element within one or more of the tubular rib structures forming lenticular knit structure 132. In some embodiments, tensile elements 724 may lie within unsecured areas forming tunnels within the tubular rib structures of lenticular knit structures 132. In different embodiments, one or more tensile elements 724 can be incorporated in knitted component 130. For example, in the embodiment shown in FIG. 1, tensile element 724 may be used to form lace receiving member 154 that forms a loop to receive lace 152 through instep area 150. Tensile elements 724 may also provide support to knitted component 130 by resisting deformation, stretching, or otherwise providing support for the wearer's foot during running, jumping, or other movements.

With this configuration, process 800 may be used to form a plurality of base portions 136 and a plurality of lenticular knit structures 132 disposed throughout a portion or a substantial majority of knitted component 130 to be incorporated into upper 120 for article 100. Generally, base portions 136 of knitted component 130 may be connecting portions between various elements and/or components of knitted component 130. Base portions 136 are formed of unitary knit construction with the remaining portions of knitted component 130 and may serve to connect various portions together as a one-piece knit element. Knitted component 130 can include any suitable number of base portions 136. In different embodiments, base portions 136 can be an area of knitted component 130 comprising one knit layer. In some embodiments, base portions 136 may extend between one portion of knitted component and another portion of knitted component 130. In one embodiment, base portions 136 can extend between one tubular rib structure and another tubular rib structure forming adjacent lenticular knit structures 132. In a different embodiment, base portions 136 may extend between one tubular rib structure and another portion of knitted component 130. In another embodiment, base portions 136 may extend between one tubular rib structure and an edge of knitted component 130. Suitable configurations of base portions 136 may be in the form of a webbed area described in co-pending and commonly-owned U.S. Provisional Patent Application Ser. No. 62/057,264, filed on Sep. 30, 2014, which was filed as U.S. patent application Ser. No. 14/535,413, on Nov. 7, 2014, and entitled "Article of Footwear Incorporating A Knitted Component with Inlaid Tensile Elements and Method of Assembly", the disclosure of which applications are hereby incorporated by reference in its entirety.

As described above, in some embodiments, lenticular knit structures 132 may be formed as tubular rib structures that are areas of knitted component 130 constructed with two or more co-extensive and overlapping knit layers. Knit layers may be portions of knitted component 130 that are formed by knitted material, for example, threads, yarns, or strands, and two or more knit layers may be formed of unitary knit construction in such a manner so as to form tubes or tunnels, identified as tubular rib structures, in knitted component 130. Although the sides or edges of the knit layers forming the tubular rib structures may be secured to the other layer, a central area is generally unsecured to form a hollow between the two layers of knitted material forming each knit layer. In some embodiments, the central area of the tubular rib structures may be configured such that another element (e.g., a tensile element) may be located between and pass through the hollow between the two knit layers forming the tubular rib structures. Suitable tubular rib structures, including with or without inlaid tensile elements, that may be used to form lenticular knit structures 132 are described in co-pending and commonly-owned U.S. Provisional Patent Application Ser. No. 62/057,264, filed on Sep. 30, 2014, and U.S. patent application Ser. No. 14/535,413, filed on Nov. 7, 2014, incorporated by reference above.

Figure 9:
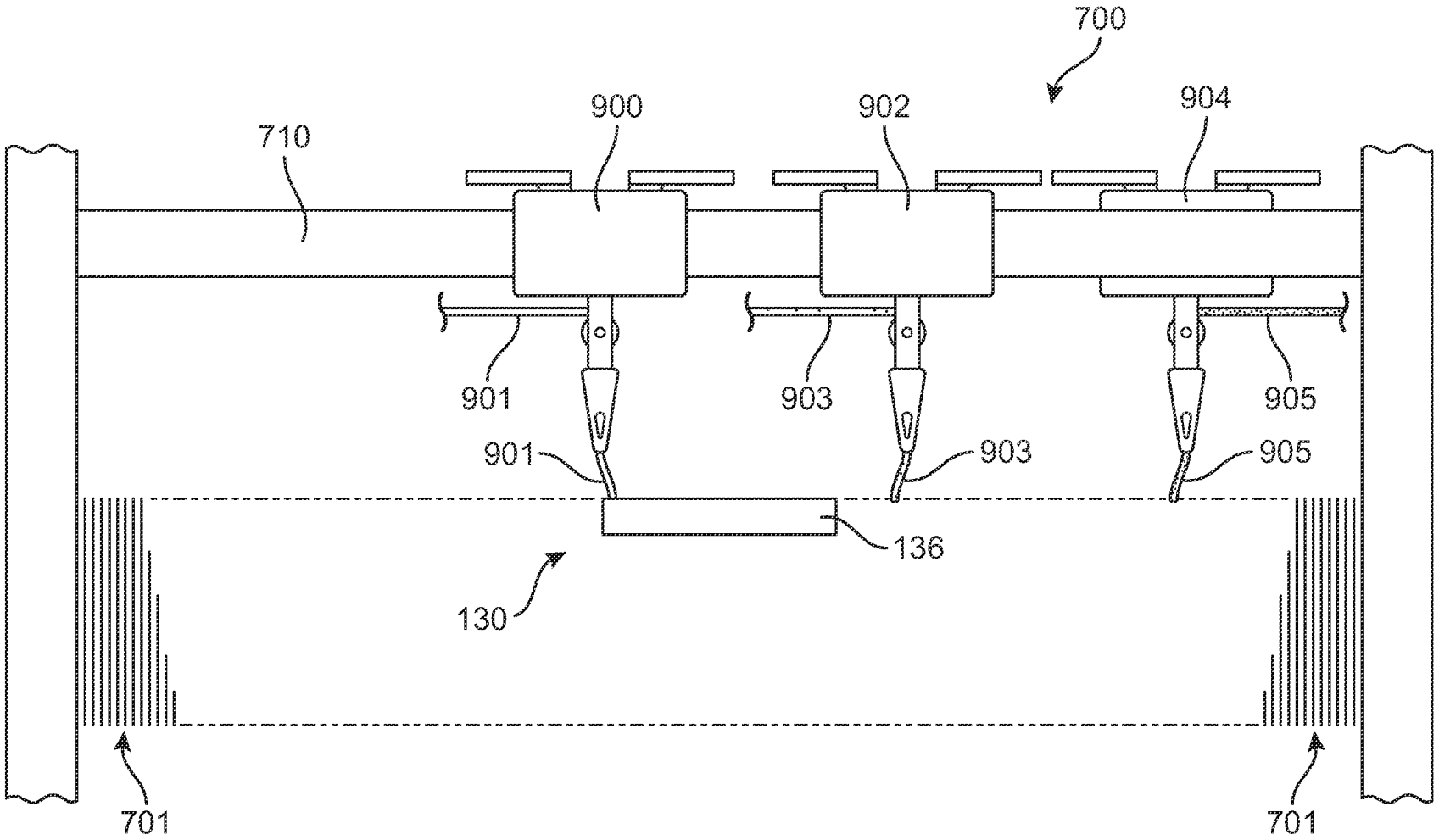
FIG. 9 is a schematic illustration of an embodiment of a method of manufacturing an embodiment of the knitted component showing a base portion being formed.
Figure 10:
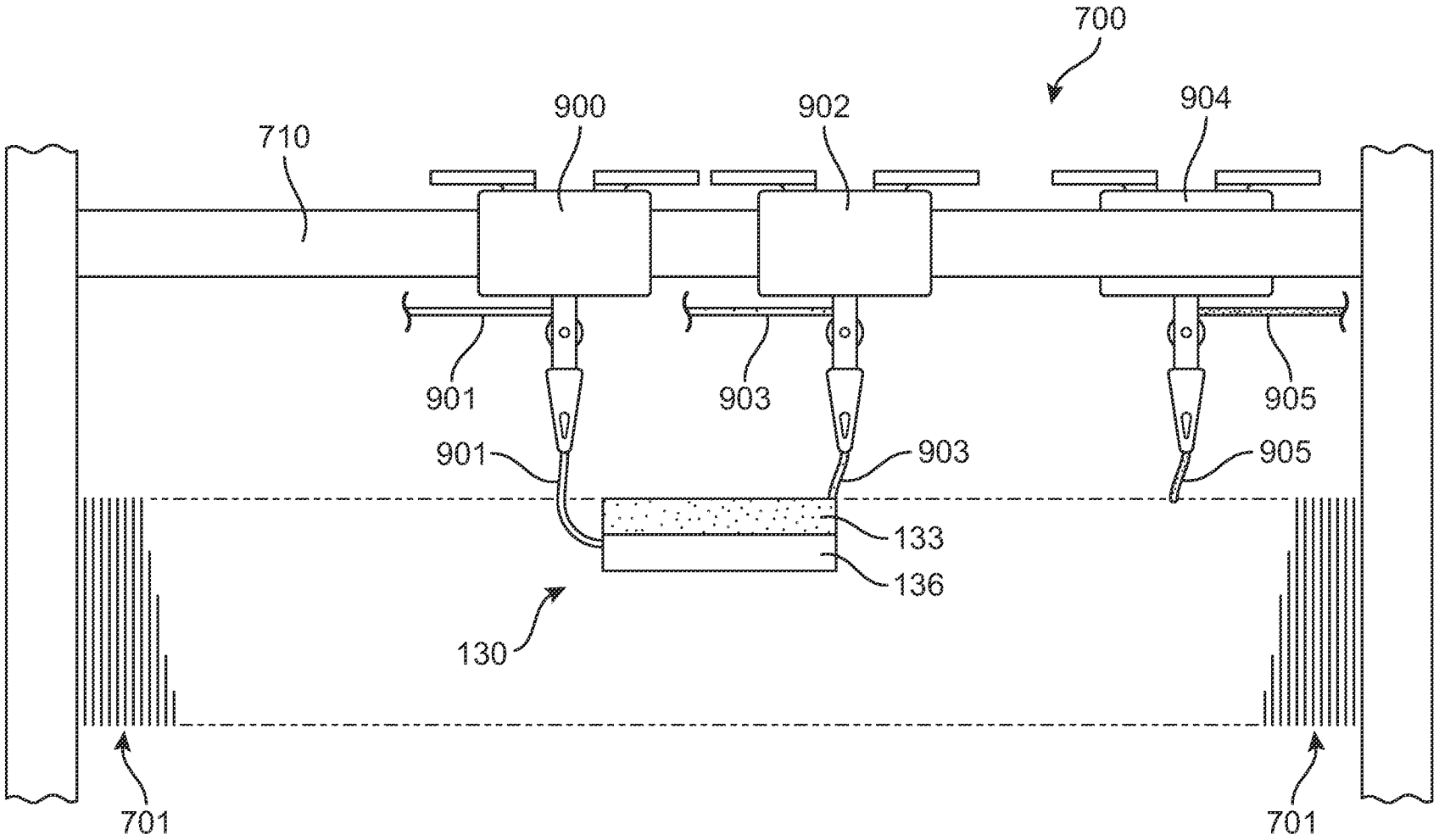
FIG. 10 is a schematic illustration of an embodiment of a method of manufacturing an embodiment of the knitted component showing a first portion of a lenticular knit structure being formed.
Figure 11:
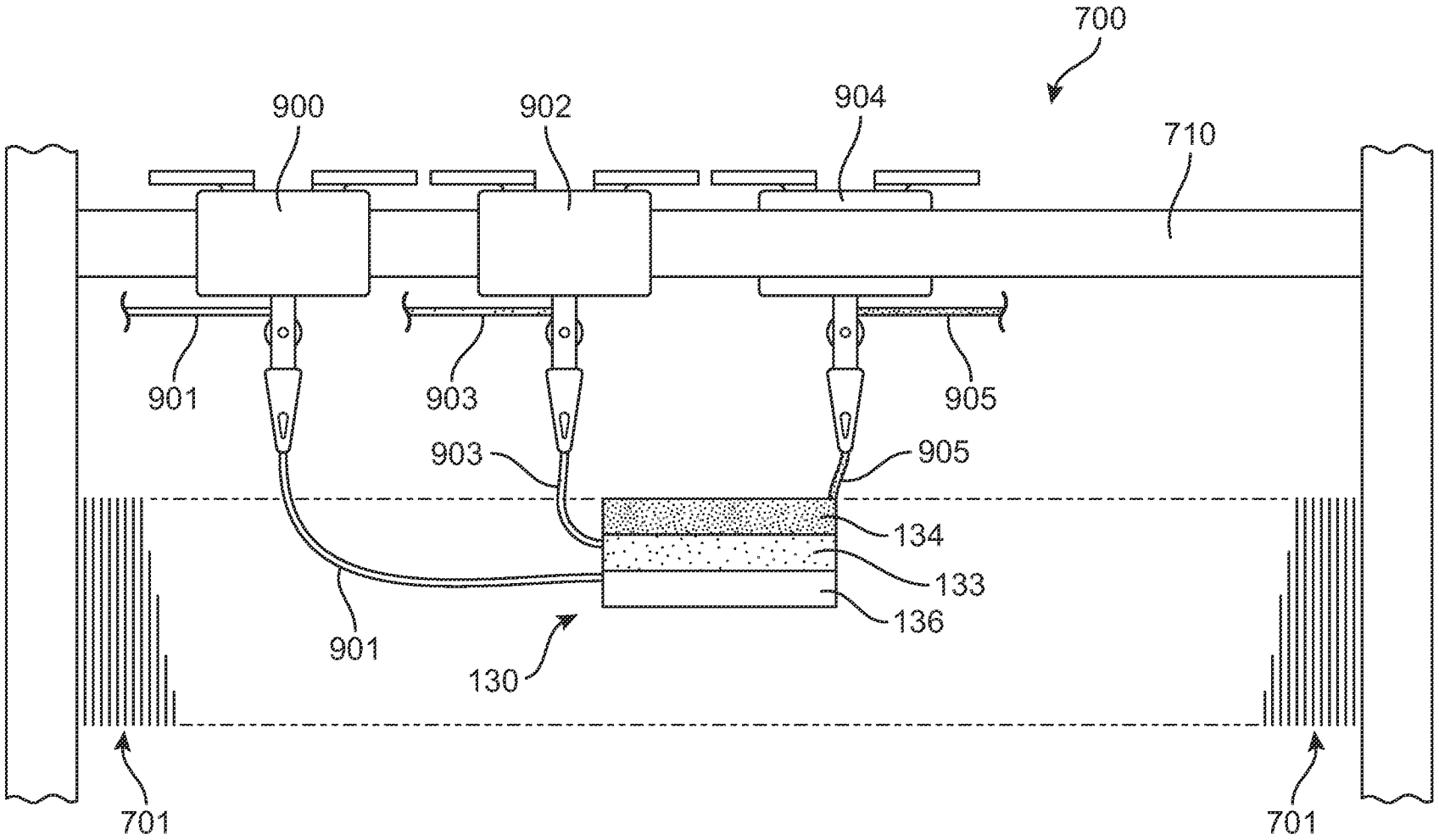
FIG. 11 is a schematic illustration of an embodiment of a method of manufacturing an embodiment of the knitted component showing a second portion of the lenticular knit structure being formed.

FIGS. 9 through 11 illustrate a sequence of representative views of knitting process 800 using knitting machine 700 to form a portion of knitted component 130. Additional steps or processes not shown here may be used to form a completed knitted component that is to be incorporated into an upper for an article of footwear, including upper 120 for article 100. In addition, only a relatively small section of a knitted component 130 may be shown in order to better illustrate the knit structure of the various portions of knitted component 130. Moreover, the scale or proportions of the various elements of knitting machine 700 and knitted component 130 may be enhanced to better illustrate the knitting process.

It should be understood that although knitted component 130 is formed between front needle bed 701 and rear needle bed 702, for purposes of illustration, in FIGS. 9 through 11, knitted component 130 is shown adjacent to front needle bed 701 and rear needle bed 702 to (a) be more visible during discussion of the knitting process and (b) show the position of portions of knitted component 130 relative to each other and needle beds. The front needles and rear needles are not depicted in FIGS. 9-11 for purposes of clarity. Also, although one rail, and limited numbers of feeders are depicted, additional rails, feeders, and spools may be used. Accordingly, the general structure of knitting machine 700 is simplified for purposes of explaining the knitting process.

Referring to FIG. 9, a portion of knitting machine 700 is shown. In this embodiment, knitting machine 700 may include a first feeder 900, a second feeder 902, and a third feeder 904. In other embodiments, additional or fewer feeders may be used and may be located on the front or rear side of forward rail 710 and/or rear rail 711. In this embodiment, a first yarn 901 from a spool (not shown) passes through first feeder 900 and an end of first yarn 901 extends outward from a dispensing tip at the end of first feeder 900. Any type of yarn (e.g., filament, thread, rope, webbing, cable, chain, or strand) may pass through first feeder 900. Second yarn 903 similarly passes through second feeder 902 and extends outward from a dispensing tip at the end of second feeder 902. In an exemplary embodiment, a third yarn 905 also similarly passes through third feeder 904 and extends outward from a dispensing tip at the end of third feeder 904. In some embodiments, first yarn 901, second yarn 903, and third yarn 905 may be used to form various portions of knitted component 130, as will be further discussed below.

In an exemplary embodiment, each of first yarn 901, second yarn 903, and third yarn 905 may be different yarn types associated with different characteristics, including, but not limited to: color, texture, denier, or other qualities, to provide the color-shifting properties to knitted component 130 caused by lenticular knit structure 132. In FIG. 9, first feeder 900 may use first yarn 901 to knit base portion 136 of knitted component 130. Each pass of first feeder 900 across the needle beds 701, 702 of knitting machine 700 produces a course of intermeshed loops formed with first yarn 901. Multiple passes of first feeder 900 may be used to knit base portion 136 having the desired number of courses. Next, according to step 804 of process 800, FIG. 10 illustrates second feeder 902 using second yarn 903 to form first portion 133 of the tubular rib structure forming one side of lenticular knit structure 132. Second feeder 902 may similarly make multiple passes to knit the desired number of courses using second yarn 903 to form first portion 133.

After the desired number of courses of second yarn 903 have been knit by second feeder 902, knitting process 800 may proceed to step 806 to knit second portion 134. As shown in FIG. 11, third feeder 904 is used to knit third yarn 905 to form one or more courses forming second portion 134 of the tubular rib structure forming the opposite side of lenticular knit structure 132. The optional step 808 of inlaying a tensile element may then be performed to place tensile element 724 within the tubular rib structure.

Figure 12:
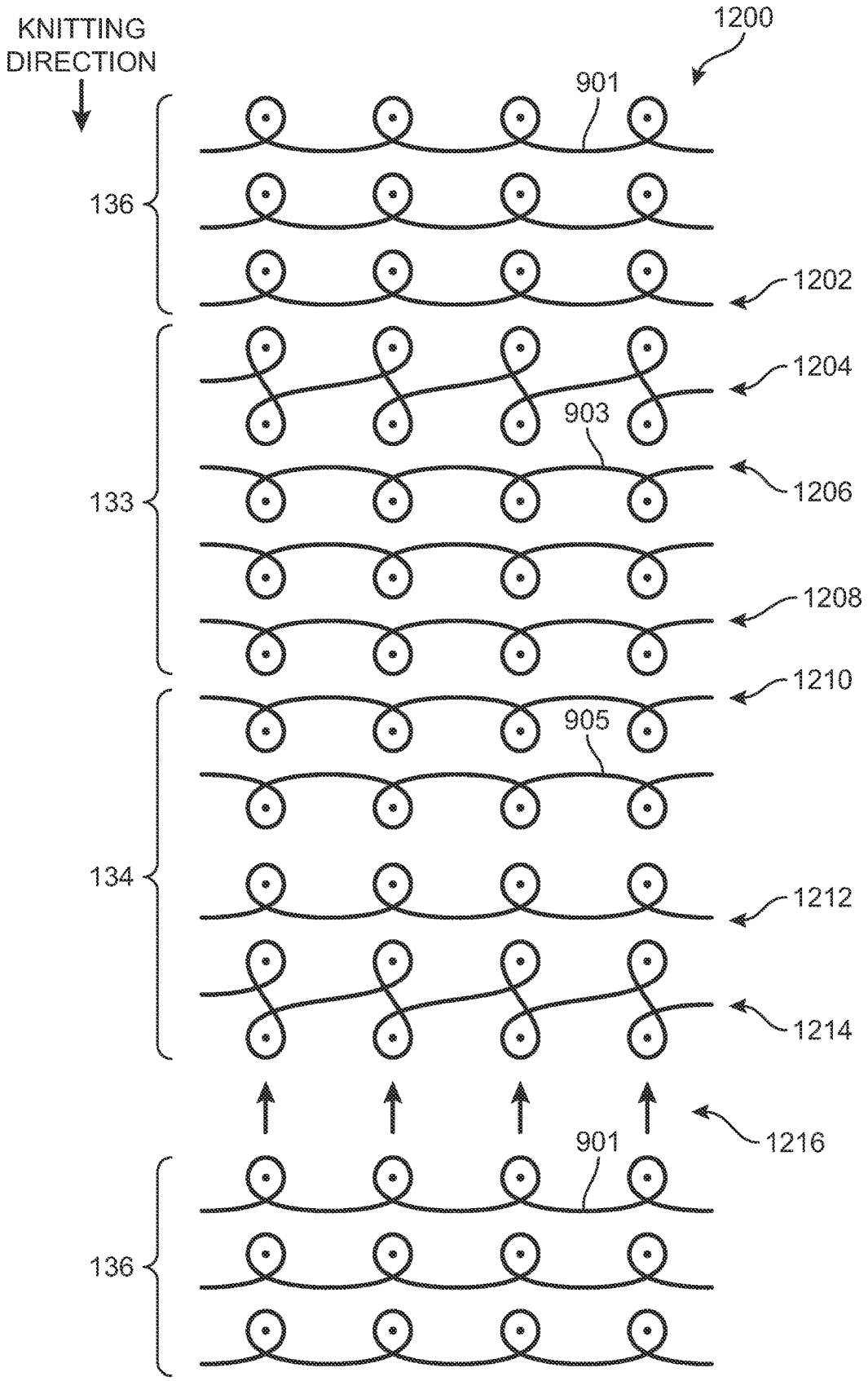
FIG. 12 is a schematic knitting diagram of an embodiment of the knitted component incorporating lenticular knit structures.
Figure 13:
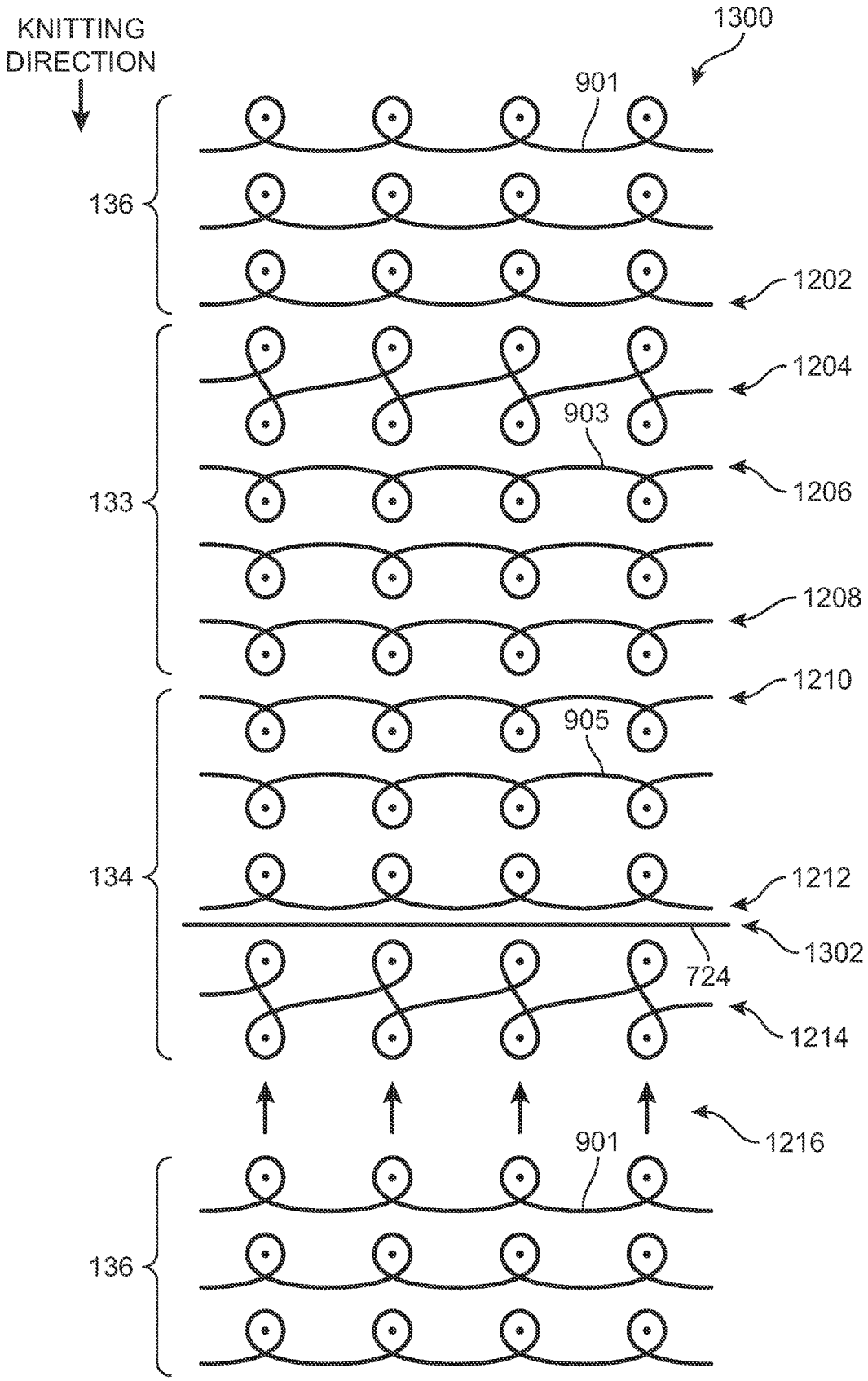
FIG. 13 is a schematic knitting diagram of an embodiment of the knitted component incorporating lenticular knit structures including an inlaid tensile element.

FIGS. 9 through 11 have been used to illustrate exemplary knitting process 800 without specific regard for the sequencing of knitting being performed with respect to any one particular sets of needles associated with either front needle bed 701 and/or rear needle bed 702. FIGS. 12 and 13 illustrate exemplary knitting or looping diagrams of the sequencing of knitting each of the portions of knitted component 130, including base portion 136, first portion 133, and second portion 134, with respect to the specific needle beds that may be used to form each portion. It should be noted, however, that FIGS. 12 and 13 illustrate one exemplary configuration of implementing process 800. Other configurations may be readily obtained according to the principles of the invention described herein to form other lenticular knit structures to provide color-shifting properties to an article.

In one embodiment of a first knitting diagram 1200, represented in FIG. 12, base portion 136 can be formed from first yarn 901 using rear needle bed 702, followed by first portion 133 of lenticular knit structure 132 being formed from second yarn 903 and second portion 134 of lenticular knit structure 132 being formed from third yarn 905 using a combination of rear needle bed 702 and front needle bed 701, and another base portion 136 can be formed from first yarn 901 using rear needle bed 702. The following discussion describes the knitting process schematically illustrated in FIGS. 12-13, and it will be understood that the front needle bed 701 and rear needle bed 702 referred to in this discussion are shown schematically in FIG. 7.

Referring again to FIG. 12, after formation of a final course 1202 of base portion 136 using first yarn 901, a linking course 1204 may be formed extending between rear needle bed 702 and front needle bed 701. Next, one or more courses may be knit on the front needle bed 701. For example, courses forming first portion 133 of lenticular knit structure 132 can be formed in a similar manner as course 1206 knit using second yarn 903 on front needle bed 701.

Next, after a final course 1208 of first portion 133 is knit on front needle bed 701 using second yarn 903, additional courses forming second portion 134 of lenticular knit structure 132 can be formed in a similar manner as course 1210 using third yarn 905 on front needle bed 701. After the desired number of courses forming second portion 134 are knit on front needle bed 701, third yarn 905 may be used to knit a course 1212 with rear needle bed 702. For example, course 1212 may form the last course of second portion 134 of lenticular knit structure 132 that closes the tubular rib structure and forms a hollow tunnel. After course 1212 finishes lenticular knit structure 132, another linking course 1214 may be formed extending between rear needle bed 702 and front needle bed 701 that is interlooped to the previous courses on the front needle bed 701 and rear needle bed 702. By using a knit stitch at linking course 1214 that extends between rear needle bed 702 and front needle bed 701, third yarn 905 forming second portion 134 of lenticular knit structure 132 can be prepared to be associated with additional courses forming another base portion 136 with first yarn 901 using rear needle bed 702 by transferring knitted component 130 to rear needle bed 702 at step 1216 and repeating the process described above until knitted component 130 is completed.

In various embodiments, different numbers of courses may be knit on one or both of front needle bed 701 and rear needle bed 702 so as to change the shape and/or size of the tubular rib structure forming lenticular knit structure 132. In some cases, by increasing or decreasing the number of courses knit on the rear needle bed 702 and/or front needle bed 701 the size of the tubular rib structure may be correspondingly enlarged or reduced. In other cases, by increasing the number of courses knit on one of the rear needle bed 702 or front needle bed 701 relative to the other, the shape of the tubular rib structure may be altered. For example, by increasing the number of courses knit on the rear needle bed 702, the shape of the tubular rib structure may be changed so as to round out the curvature on interior surface 122 of knitted component 130 to be similar to the curvature on exterior surface 121 of knitted component 130. Additionally, by increasing or decreasing the number of courses knit with each of second yarn 903 and/or third yarn 905, the extent or amount of first portion 133 and/or second portion 134 may be similarly modified.

For example, by increasing the number of courses knit with second yarn 903 to form first portion 133 and/or decreasing the number of courses knit with third yarn 905 to form second portion 134, the color-shifting properties provided to knitted component 130 by a lenticular knit structure with this configuration may be altered so as to increase the number of viewing angles that are associated with the visual effect or color from first portion 133 and/or decreasing the number of viewing angles that are associated with the visual effect or color from second portion 134. That is, a lenticular knit structure having a larger first portion than a second portion will have more viewing angles that are associated with the visual effect caused by the first portion than the second portion, given the greater extent of the second yarn forming the resulting lenticular knit structure.

In the exemplary knitting diagram 1200 described in reference to FIG. 12, lenticular knit structure 132 is formed as a hollow tubular rib structure. In other embodiments, a tensile element may be inlaid within the unsecured central area of one or more lenticular knit structures 132 forming tubular rib structures. FIG. 13 illustrates an exemplary knitting diagram 1300 for forming lenticular knit structure 132 including inlaid tensile element 724. As shown in FIG. 13, the process is substantially similar as the process shown in knitting diagram 1200 for forming lenticular knit structure 132 as a hollow tubular rib structure illustrated in FIG. 12.

However, in the process of FIG. 13, after forming course 1212 on rear needle bed 702, tensile element 724 is inlaid within a portion of the tubular rib structure forming lenticular knit structure 132 at an inlaying step 1302. Tensile element 724 may be inlaid at step 1302 using a combination feeder and associated method of inlaying described in described in U.S. Pat. No. 8,522,577 to Huffa, incorporated by reference above.

After tensile element 724 is inlaid within lenticular knit structure 132 at step 1302, the process shown in knitting diagram 1300 proceeds in a substantially similar manner as in knitting diagram 1200. That is, another linking course 1214 may be formed extending between rear needle bed 702 and front needle bed 701 that is interlooped to the previous courses on the front needle bed 701 and rear needle bed 702. By using a knit stitch at linking course 1214 that extends between rear needle bed 702 and front needle bed 701, third yarn 905 forming second portion 134 of lenticular knit structure 132 can be prepared to be associated with additional courses forming another base portion 136 with first yarn 901 using rear needle bed 702 by transferring knitted component 130 to rear needle bed 702 at step 1216 and repeating the process described above until knitted component 130 is completed. With this configuration, lenticular knit structure 132 including an inlaid tensile element 724 is formed with tensile element 724 being contained within the hollow unsecured area within the tubular rib structure extending along the length of lenticular knit structure 132.

In other embodiments, the formation of knitted component 130 may be similar but entail a switch in the needle beds used. For example, the knitting process shown in FIGS. 12 and 13 may be performed using opposite needle beds, such that base portion 136 can be formed using front needle bed 701 and the remaining steps shown in FIGS. 12 and 13 can be performed in identical order using the opposite needle bed than illustrated. Other methods of using the various needle beds of knitting machine 700 to form base portion 136 and lenticular knit structure 132, including first portion 133 and second portion 134, will be apparent to one of ordinary skill in the art based on the above description.

Figure 14:
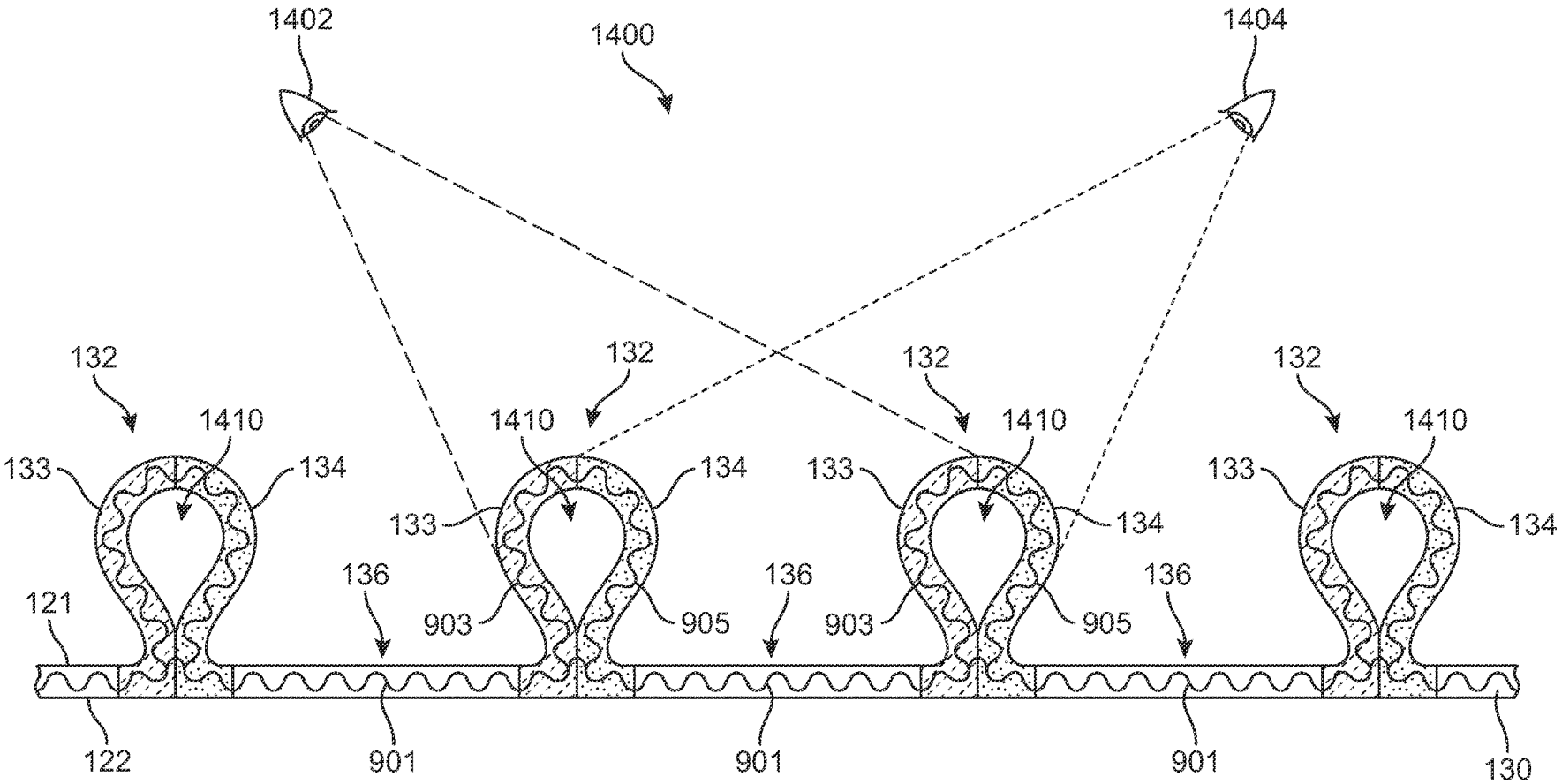
FIG. 14 is a representational view of a cross section of a knitted component incorporating lenticular knit structures.
Figure 15:
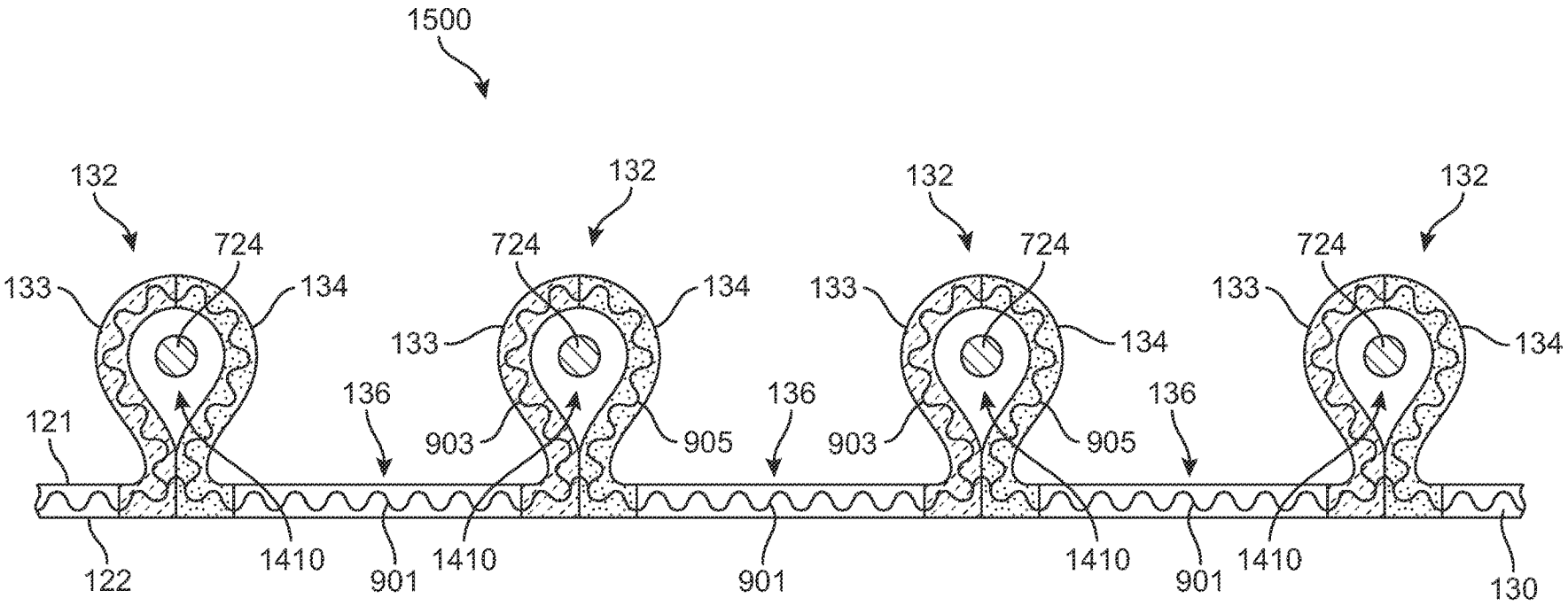
FIG. 15 is a representational view of a cross section of a knitted component incorporating lenticular knit structures including an inlaid tensile element.

FIGS. 14 and 15 illustrate representational views of a cross section of knitted component 130 incorporating lenticular knit structures 132. FIG. 14 illustrates representational view 1400 of a portion of knitted component 130 incorporating lenticular knit structures 132 with hollow unsecured areas 1410. As shown in this embodiment, each lenticular knit structure 132 includes first portion 133 formed using second yarn 903 and second portion 134 formed using third yarn 905. In an exemplary embodiment, at least one course of first portion 133 formed with second yarn 903 is interlooped with at least one course of second portion 134 formed with third yarn 905. With this configuration, first portion 133 and second portion 134 are formed of unitary knit construction. Spaced between and separating each of lenticular knit structures 132 are base portion 136 of knitted component 130. Base portion 136 is formed from first yarn 901, as described above, and is also formed of unitary knit construction with first portion 133 and second portion 134 on respective sides of lenticular knit structure 132.

The configuration of lenticular knit structure 132 including first portion 133 formed by second yarn 903 on one side of the tubular rib structure and second portion 134 formed by third yarn 905 on the opposite side of the tubular rib structure provides the color-shifting properties to knitted component 130. As noted above, in various embodiments, second yarn 903 and third yarn 905 may be different types that provide different visual effects. For example, in this embodiment, second yarn 903 may be associated with a first color and third yarn 905 may be associated with a second color that is different from the first. In other embodiments, however, second yarn 903 and third yarn 905 may be of types having different characteristics that may cause a visual color-shifting effect.

The color-shifting properties of knitted component 130 provided by lenticular knit structures 132 will be described with reference to representational view 1400. In this embodiment, when knitted component 130 is viewed from a first viewing angle 1402, first portion 133 formed by second yarn 903 is primarily and substantially presented towards the viewer. Thus, from first viewing angle 1402, first portion 133 of lenticular knit structure 132 may provide the primary overall visual effect of knitted component 130 to the viewer. In this case, the characteristics associated with second yarn 903 forming first portion 133 provide the visual effect, for example, the color of second yarn 903.

In contrast, when knitted component 130 is viewed from a second viewing angle 1404 that is different from first viewing angle 1402, the viewer is presented with a different visual effect. In this embodiment, when knitted component 130 is viewed from second viewing angle 1404, second portion 134 formed by third yarn 905 is primarily and substantially presented towards the viewer. Thus, from second viewing angle 1404, second portion 134 of lenticular knit structure 132 may provide the primary overall visual appearance of knitted component 130 to the viewer. In this case, the characteristics associated with third yarn 905 forming second portion 134 provide the visual effect, for example, the color of third yarn 905 that is different from the color of second yarn 903. As noted previously, in other embodiments, the varying visual effect provided between second yarn 903 and third yarn 905 may include other characteristics, including, but not limited to yarn type, denier, texture, or other properties that generate differing visual effects.

With this configuration of lenticular knit structures 132 on knitted component 130, the color-shifting properties of upper 120 and/or article 100 may be provided so that a viewer observes a change in the visual effect of upper 120 and/or article 100 as the viewing angle changes, for example, as the viewing angle changes between first viewing angle 1402 and second viewing angle 1404. In addition, as noted above, in some embodiments, base portion 136 may be formed using first yarn 901 that is similar or different to either or both of second yarn 903 and third yarn 905 to coordinate or contrast with first portion 133 and/or second portion 134 of lenticular knit structure 132 to further assist with the visual effect provided to knitted component 130.

Referring now to FIG. 15, a representational view 1500 of a portion of knitted component 130 incorporating lenticular knit structures 132 with unsecured areas 1410 including tensile elements 724 is illustrated. In this embodiment, each of lenticular knit structures 132 includes an inlaid tensile element 724 extending through unsecured area 1410 within the interior of the tubular rib structure forming lenticular knit structure 132. As shown in FIG. 15, each lenticular knit structure 132 includes an accompanying tensile element 724. In other embodiments, however, tensile elements 724 may be disposed in only selected lenticular knit structures 132 located in specific areas or regions of knitted component 130. For example, as shown in FIG. 1, tensile elements 724 may be included in lenticular knit structures 132 located along instep area 150 so as to provide lace receiving members 154 that forms loops to receive lace 152. In still other embodiments, tensile elements 724 may be omitted.

The previous embodiments of knitted component 130 illustrated lenticular knit structures 132 having two portions formed using different yarns to provide the color-shifting properties to upper 120 and article 100. In other embodiments, a lenticular knit structure may be formed that includes additional portions formed using another type of yarn different from both of the yarns forming the first and second portions of the lenticular knit structure. FIGS. 16 through 22 illustrate an exemplary embodiment of an article of footwear 1600 that includes lenticular knit structures having three portions formed using different yarns.

Figure 17:
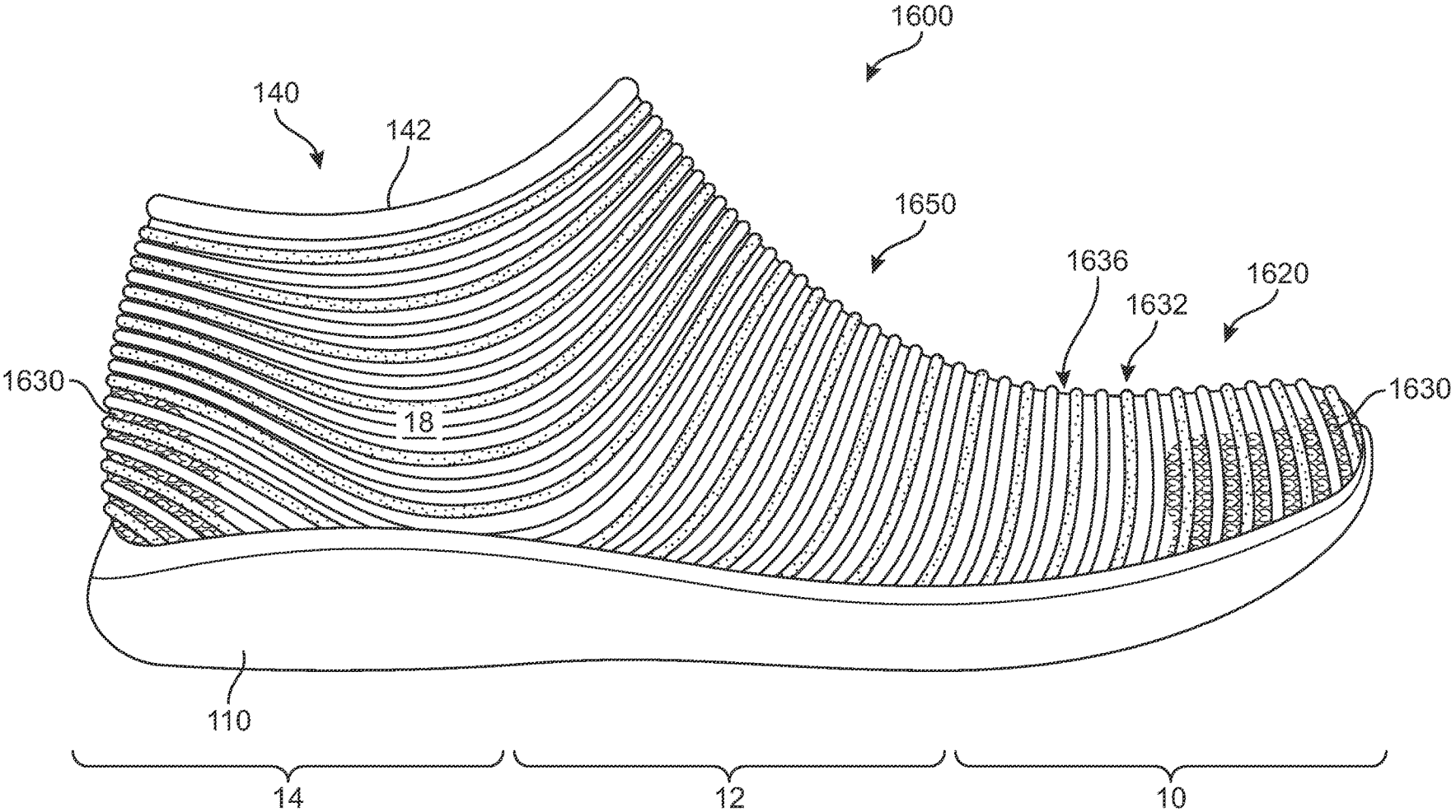
FIG. 17 is a medial side view of the alternate embodiment of an article of footwear incorporating a knitted component having lenticular knit structures.
Figure 18:
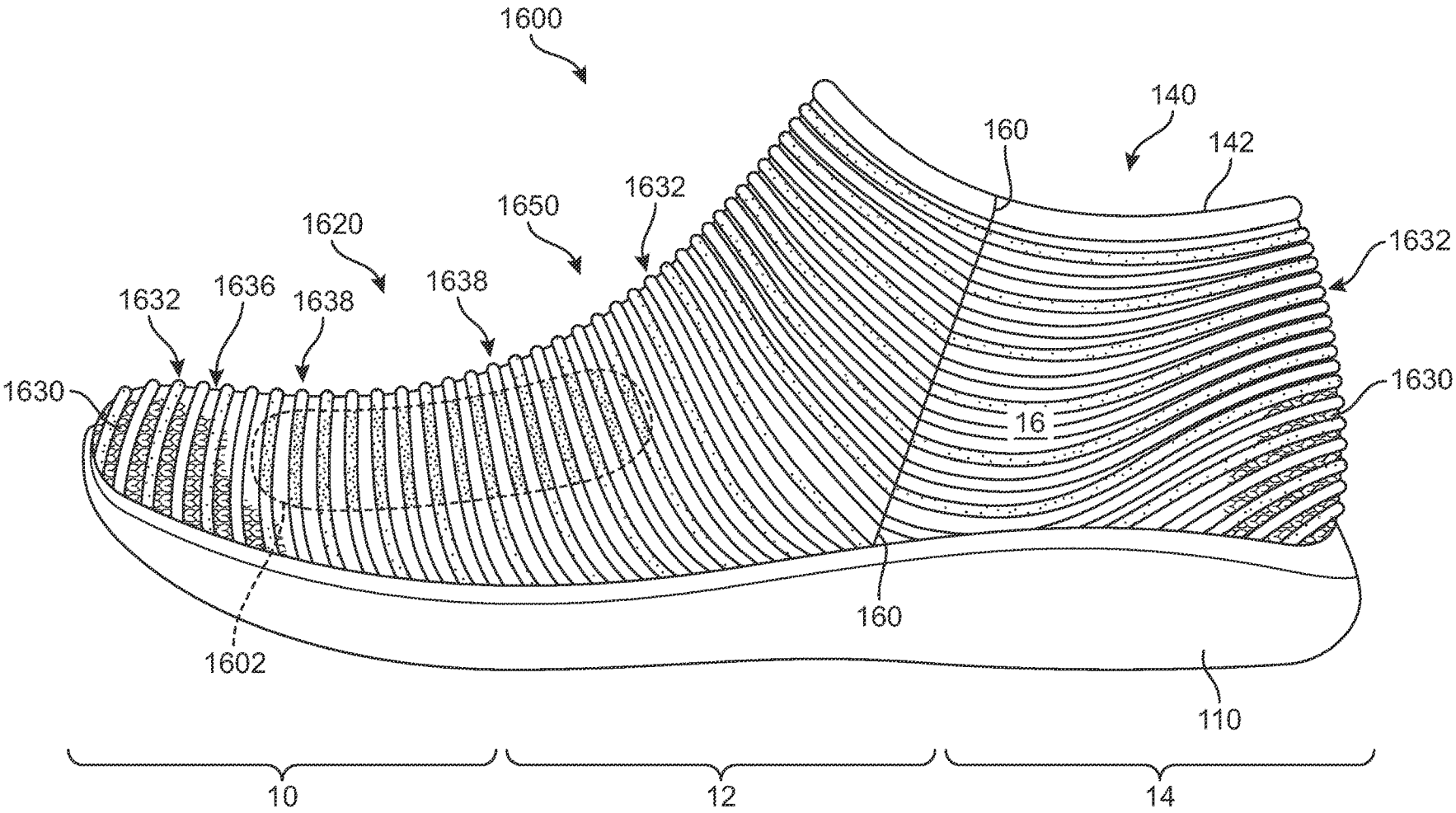
FIG. 18 is a lateral side view of the exemplary embodiment of an article of footwear incorporating a knitted component having lenticular knit structures including the area associated with three colors.
Figure 19:
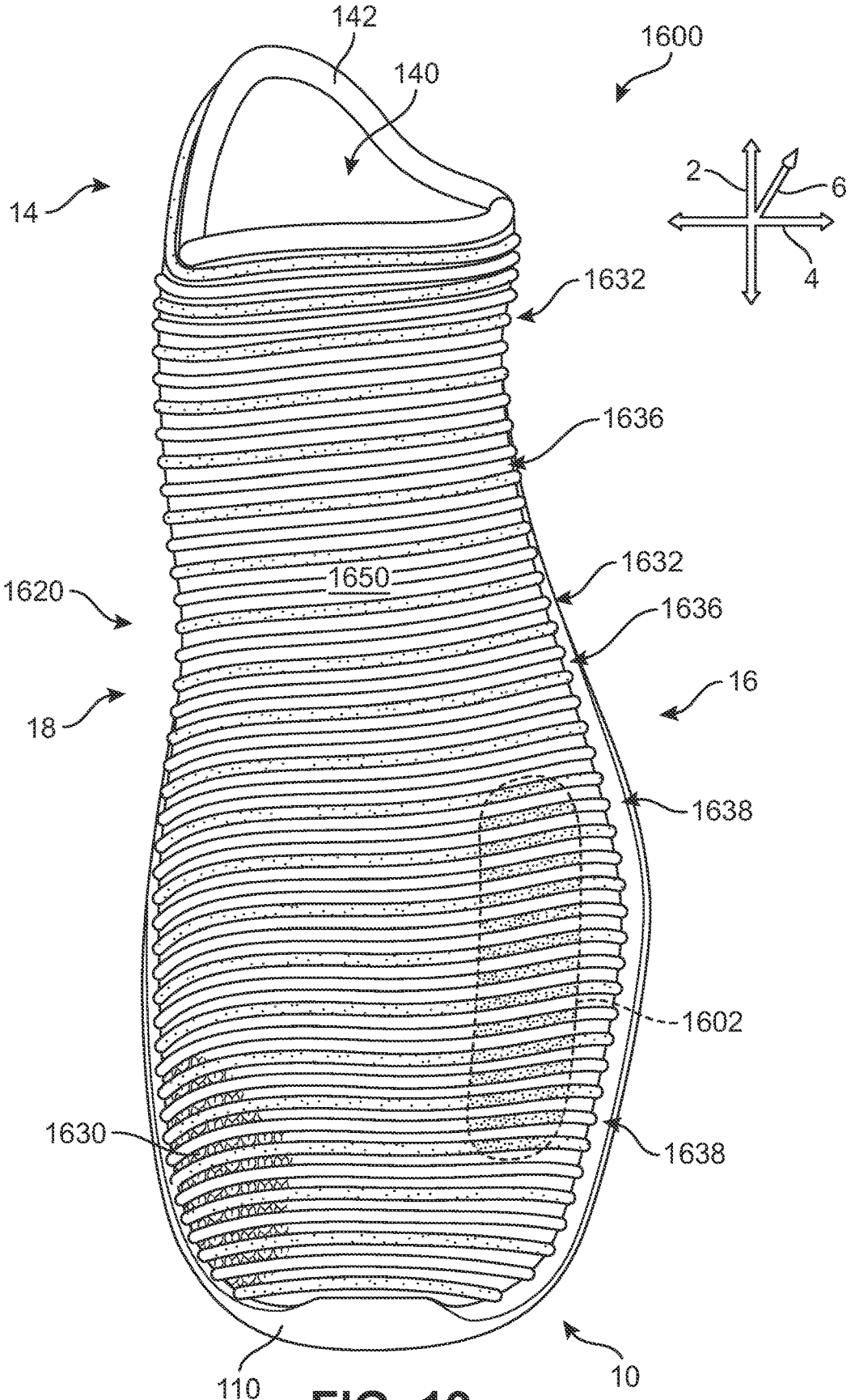
FIG. 19 is a top front view of the alternate embodiment of an article of footwear incorporating a knitted component having lenticular knit structures including an area associated with three colors.

An exemplary coordinate system for describing the exemplary embodiment of article 1600 shown in FIGS. 16 through 22 is illustrated in FIG. 19, where a longitudinal direction 2 extends along article 1600 between forefoot region 10 to heel region 14 of article 1600, a lateral direction 4 extends along article 1600 between lateral side 16 and medial side 18, and a vertical direction 6 extends along article 1600 between sole structure 110 and a top of article 1600.

In some embodiments, article 1600 includes an upper 1620 that includes components that are substantially similar to the components associated with upper 120, described above. For example, upper 1620 may include throat opening 140 surrounded by collar 142, and may be joined along seam 160, as described above. Similarly, upper 1620 may include exterior surface 121 and interior surface 122 associated with, respectively, the outside and inside of article 1600. Upper 1620 may be joined or secured to sole structure 110 to complete article of footwear 1600.

In an exemplary embodiment, upper 1620 incorporates a knitted component 1630 that includes first lenticular knit structures 1632 having two portions formed from two different yarns, in a substantially similar manner as, and substantially similar to, lenticular knit structures 132, described above. In an exemplary embodiment, knitted component 1630 further includes at least one area 1602 with second lenticular knit structures 1638 having three portions formed from three different yarns. Additionally, in this embodiment, knitted component 1630 includes base portions 1636 that are disposed between one or more of first lenticular knit structures 1632 and/or second lenticular knit structures 1638. In one embodiment, base portions 1636 may be formed in a substantially similar manner as, and substantially similar to, base portions 136, described above.

Figure 16:
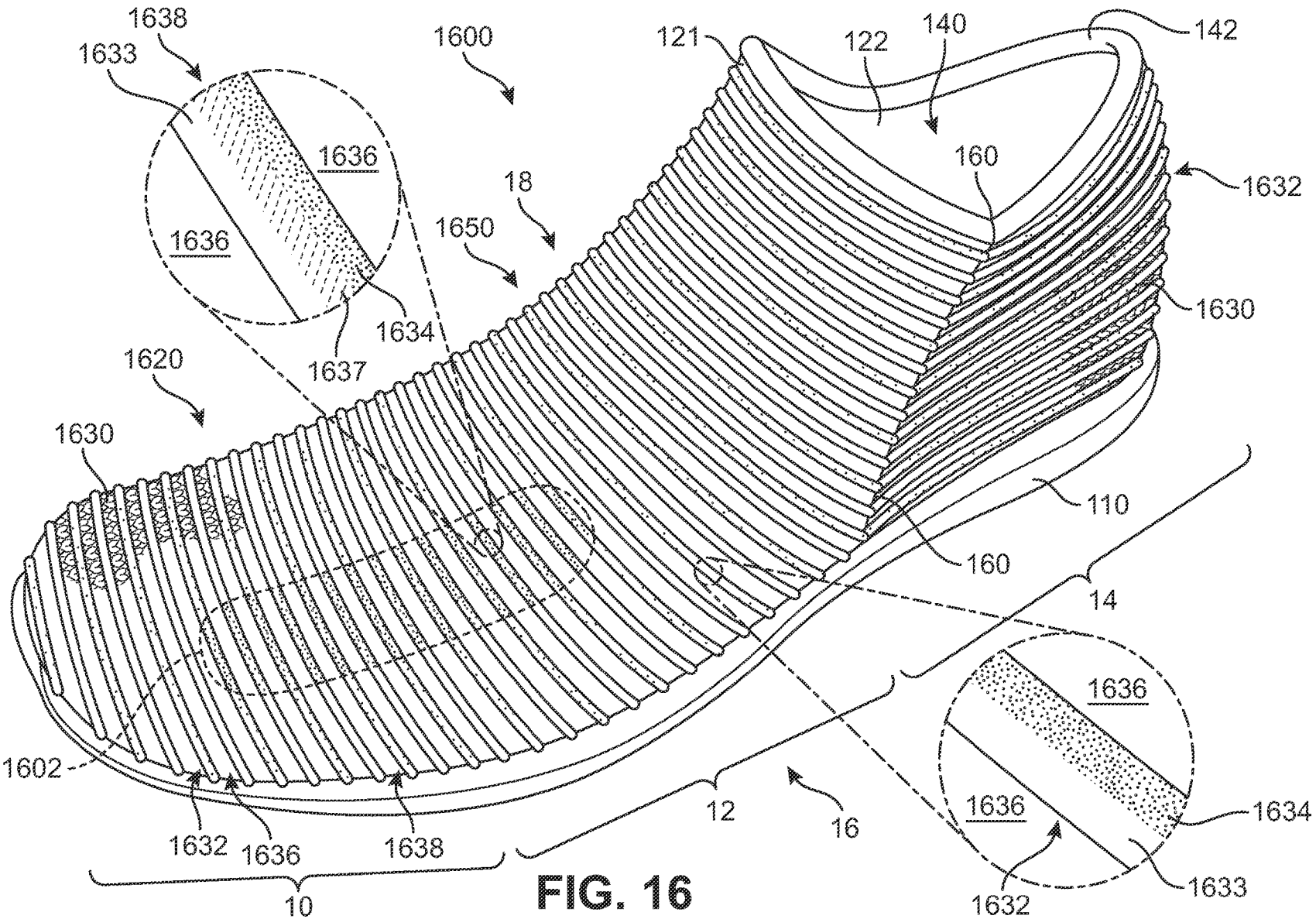
FIG. 16 is an isometric view of an alternate embodiment of an article of footwear incorporating a knitted component having lenticular knit structures including an area associated with three colors.

Referring to FIG. 16, in this embodiment, knitted component 1630 includes area 1602 having one or more second lenticular knit structures 1638, while the remaining portion of knitted component 1630 includes first lenticular knit structures 1632. While this embodiment illustrates a single area 1602 having second lenticular knit structures 1638, it should be understood that additional or different areas located on other areas or portions of knitted component 1630 may be provided. Additionally, in some embodiments, area 1602 may be selected so as to serve as an indicia, logo, pattern, or other visual effect that is different from the remaining portions of knitted component 1630.

In an exemplary embodiment, first lenticular knit structures 1632 may provide color-shifting properties to knitted component 1630 through incorporation of two or more types of yarn being used to knit first lenticular knit structure 1632. For example, in embodiments where lenticular knit structure 1632 is in the form of a tubular rib structure, different portions of first lenticular knit structure 1632 may include different types of yarn along each side of the tubular rib structure. In one embodiment, a first portion 1633 of first lenticular knit structure 1632 disposed on one side of the tubular rib structure may be knit using a first yarn and a second portion 1634 of first lenticular knit structure 1632 disposed on the opposite side of the tubular rib structure may be knit using a second yarn that is different from the first yarn. In some cases, the types of yarn may vary in color to provide the color-shifting properties to knitted component 1630. In other cases, the types of yarn may vary in texture or denier to provide the color-shifting properties to knitted component 1630.

In some embodiments, knitted component 1630 further includes area 1602 with second lenticular knit structures 1638. Second lenticular knit structures 1638 may similarly provide color-shifting properties to knitted component 1630 through incorporation of two or more types of yarn being used to knit the lenticular knit structure 1638, as with first lenticular knit structure 1632. For example, in embodiments where second lenticular knit structure 1638 is in the form of a tubular rib structure, different portions of second lenticular knit structure 1638 may similarly include different types of yarn along each side of the tubular rib structure, including first portion 1633 of second lenticular knit structure 1638 disposed on one side of the tubular rib structure knit using the first yarn and second portion 1634 of second lenticular knit structure 1638 disposed on the opposite side of the tubular rib structure may be knit using the second yarn that is different from the first yarn. In this embodiment, second tubular knit structure 1638 further includes an upper portion 1637 disposed on the top of the tubular rib structure using a third yarn that is different from both the first yarn and the second yarn used for each of first portion 1633 and second portion 1634. With this configuration, second lenticular knit structure 1638 may present a third visual effect caused by upper portion 1637 to knitted component 1630 that is different from the visual effects presented by first portion 1633 and/or second portion 1634 disposed along the sides of second lenticular knit structures 1638 and first lenticular knit structures 1632.

In one embodiment, area 1602 having second lenticular knit structures 1638 may be located approximately in a portion of forefoot region 10 and/or midfoot region 12 and be offset towards lateral side 16 of article 1600. With this arrangement, area 1602 may present the third visual effect to a viewer when article 1600 and upper 1620 are viewed from a viewing angle that includes at least a portion of lateral side 16, while area 1602 may not present the third visual effect to a viewer when article 1600 and upper 1620 are viewed from a viewing angle that is primarily along medial side 18. For example, as shown in medial side view illustrated in FIG. 17, area 1602 is not visible from medial side 18. However, as shown in lateral side view illustrated in FIG. 18, area 1602 is visible from lateral side 16. Similarly, when viewing article 1600 and upper 1620 from a top or front view illustrated in FIG. 19, area 1602 is also visible to the viewer. With this configuration, area 1602 including second lenticular knit structures 1638 may be selectively provided on various portions of knitted component 1630. In different embodiments, however, area 1602 or additional areas, may be located on different portions of upper 1620 as desired to produced different color-shifting properties to those portions of upper 1620.

Figure 20:
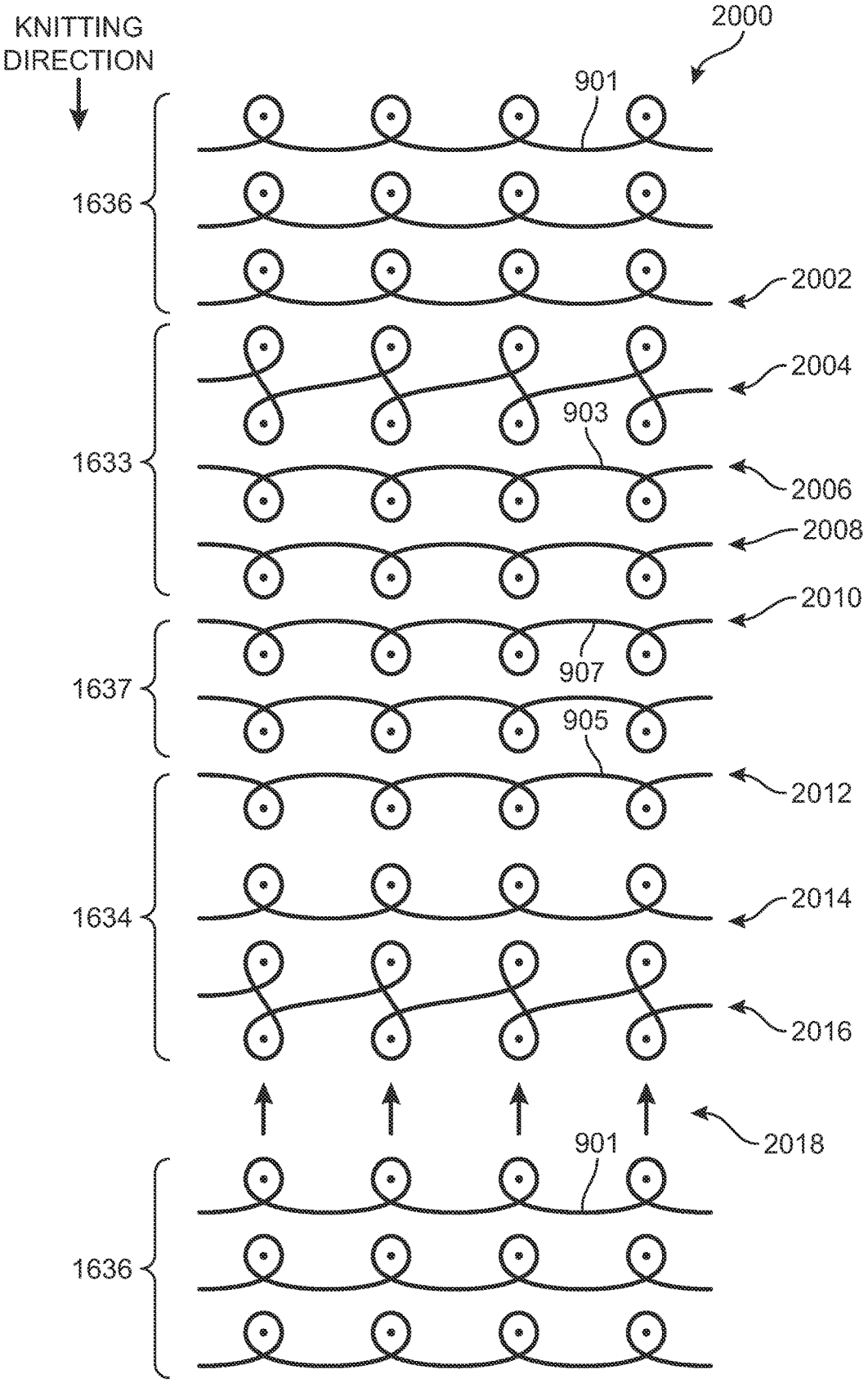
FIG. 20 is a schematic knitting diagram of an alternate embodiment of the knitted component incorporating lenticular knit structures having three colors.
Figure 21:
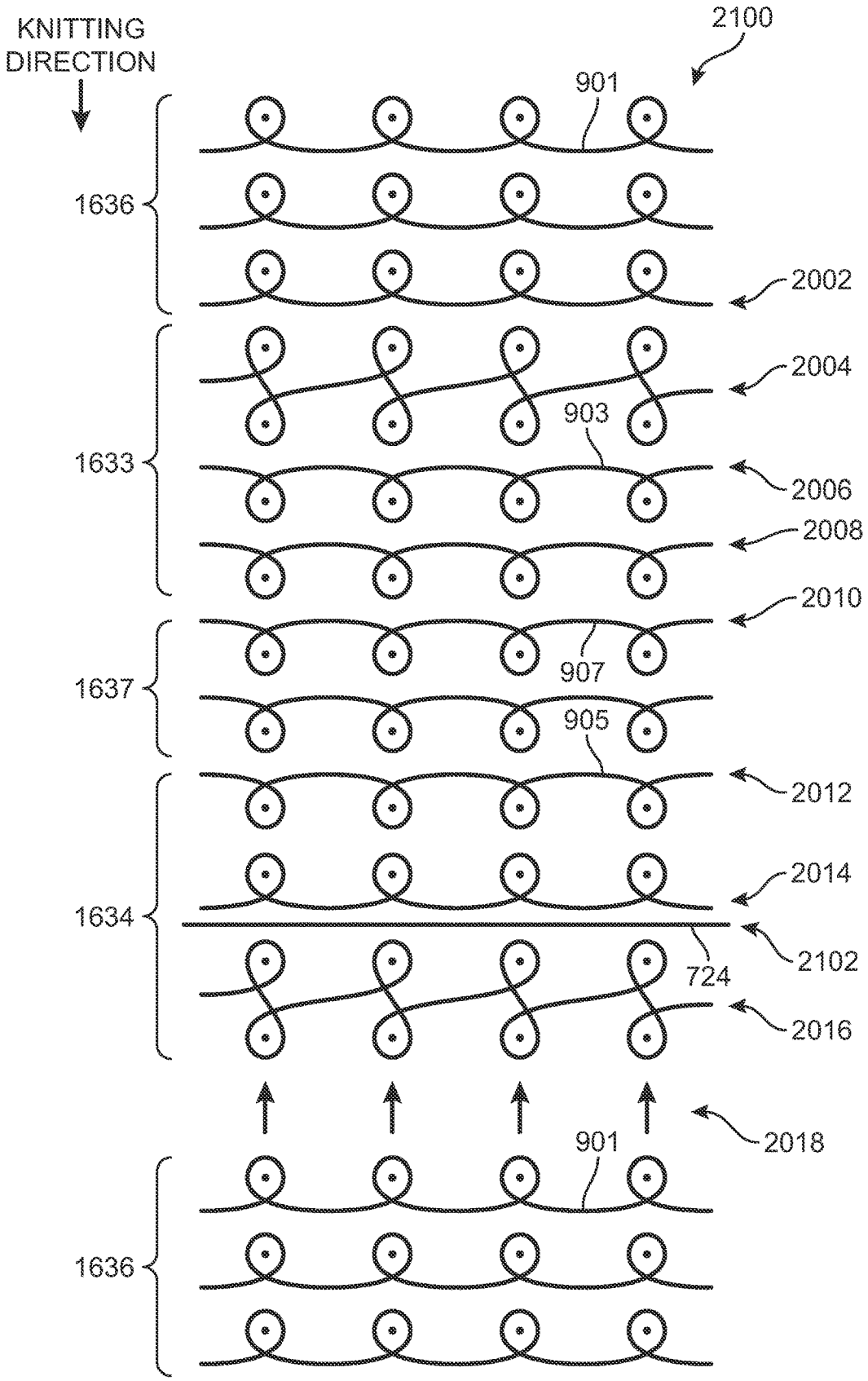
FIG. 21 is a schematic knitting diagram of an embodiment of the knitted component incorporating lenticular knit structures having three colors including an inlaid tensile element.

As noted above, first lenticular knit structure 1632 may be formed in a substantially similar manner as lenticular knit structure 132, described above and shown in particular with reference to knitting diagrams 1200 and 1300 in FIGS. 12 and 13. The knitting process for knitting second lenticular knit structure 1638 may include many similar steps as first lenticular knit structure 1632 and/or lenticular knit structure 132. In contrast, however, a third yarn may be used to form upper portion 1637 of second lenticular knit structure 1638 so as to present the third visual effect to knitted component 1630. FIGS. 20 and 21 illustrate exemplary knitting or looping diagrams of the sequencing of knitting each of the portions of knitted component 1630, including base portion 1636, first portion 1633, second portion 1634, and upper portion 1637, with respect to the specific needle beds that may be used to form each portion. It should be noted, however, that FIGS. 20 and 21 illustrate one exemplary configuration of implementing a knitting process for forming knitted component 1630. Other configurations may be readily obtained according to the principles of the invention described herein to form other lenticular knit structures to provide color-shifting properties to an article.

In one embodiment of a third knitting diagram 2000, represented in FIG. 20, base portion 1636 can be formed from first yarn 901 using rear needle bed 702, followed by first portion 1633 of second lenticular knit structure 1638 being formed from second yarn 903 and second portion 1634 of second lenticular knit structure 1638 being formed from third yarn 905 using a combination of rear needle bed 702 and front needle bed 701, and another base portion 1636 can be formed from first yarn 901 using rear needle bed 702. The following discussion describes the knitting process schematically illustrated in FIGS. 20-21, and it will be understood that the front needle bed 701 and rear needle bed 702 referred to in this discussion are shown schematically in FIG. 7.

Referring again to FIG. 20, after formation of a final course 2002 of base portion 1636 using first yarn 901, a linking course 2004 may be formed extending between rear needle bed 702 and front needle bed 701. Next, one or more courses may be knit on the front needle bed 701. For example, courses forming first portion 1633 of second lenticular knit structure 1638 can be formed in a similar manner as course 2006 knit using second yarn 903 on front needle bed 701. Next, after a final course 2008 of first portion 1633 is knit on front needle bed 701 using second yarn 903, courses forming upper portion 1637 of second lenticular knit structure 1638 can be formed in a similar manner as course 2010 using fourth yarn 907.

After the desired number of courses forming upper portion 1637 are knit using fourth yarn 907, additional courses forming second portion 1634 of second lenticular knit structure 1638 can be formed in a similar manner as course 2012 using third yarn 905 on front needle bed 701. After the desired number of courses forming second portion 1634 are knit on front needle bed 701, third yarn 905 may be used to knit a course 2014 with rear needle bed 702. For example, course 2014 may form the last course of second portion 1634 of second lenticular knit structure 1638 that closes the tubular rib structure and forms a hollow tunnel. After course 2014 finishes second lenticular knit structure 1638, another linking course 2016 may be formed extending between rear needle bed 702 and front needle bed 701 that is interlooped to the previous courses on the front needle bed 701 and rear needle bed 702. By using a knit stitch at linking course 2016 that extends between rear needle bed 702 and front needle bed 701, third yarn 905 forming second portion 1634 of second lenticular knit structure 1638 can be prepared to be associated with additional courses forming another base portion 1636 with first yarn 901 using rear needle bed 702 by transferring knitted component 1630 to rear needle bed 702 at step 2018 and repeating the process described above until knitted component 1630 is completed.

In various embodiments, different numbers of courses may be knit on one or both of front needle bed 701 and rear needle bed 702 so as to change the shape and/or size of the tubular rib structure forming second lenticular knit structure 1638, as described above with regard to lenticular knit structure 132.

In the exemplary knitting diagram 2000 described in reference to FIG. 20, second lenticular knit structure 1638 is formed as a hollow tubular rib structure. In other embodiments, a tensile element may be inlaid within the unsecured central area of one or more second lenticular knit structures 1638 forming tubular rib structures, in a similar manner as first lenticular knit structures 1632 and/or lenticular knit structures 132. FIG. 21 illustrates an exemplary knitting diagram 2100 for forming second lenticular knit structure 1638 including inlaid tensile element 724. As shown in FIG. 21, the process is substantially similar as the process shown in knitting diagram 2000 for forming second lenticular knit structure 1638 as a hollow tubular rib structure illustrated in FIG. 20.

However, in the process of FIG. 21, after forming course 2014 on rear needle bed 702, tensile element 724 is inlaid within a portion of the tubular rib structure forming second lenticular knit structure 1638 at an inlaying step 2102. Tensile element 724 may be inlaid at step 2102 using a combination feeder and associated method of inlaying described in described in U.S. Pat. No. 8,522,577 to Huffa, incorporated by reference above.

After tensile element 724 is inlaid within second lenticular knit structure 1638 at step 2102, the process shown in knitting diagram 2100 proceeds in a substantially similar manner as in knitting diagram 2000. That is, another linking course 2016 may be formed extending between rear needle bed 702 and front needle bed 701 that is interlooped to the previous courses on the front needle bed 701 and rear needle bed 702. By using a knit stitch at linking course 2016 that extends between rear needle bed 702 and front needle bed 701, third yarn 905 forming second portion 1634 of second lenticular knit structure 1638 can be prepared to be associated with additional courses forming another base portion 1636 with first yarn 901 using rear needle bed 702 by transferring knitted component 1630 to rear needle bed 702 at step 2018 and repeating the process described above until knitted component 1630 is completed. With this configuration, second lenticular knit structure 1638 including an inlaid tensile element 724 is formed with tensile element 724 being contained within the hollow unsecured area within the tubular rib structure extending along the length of second lenticular knit structure 1638.

Figure 22:
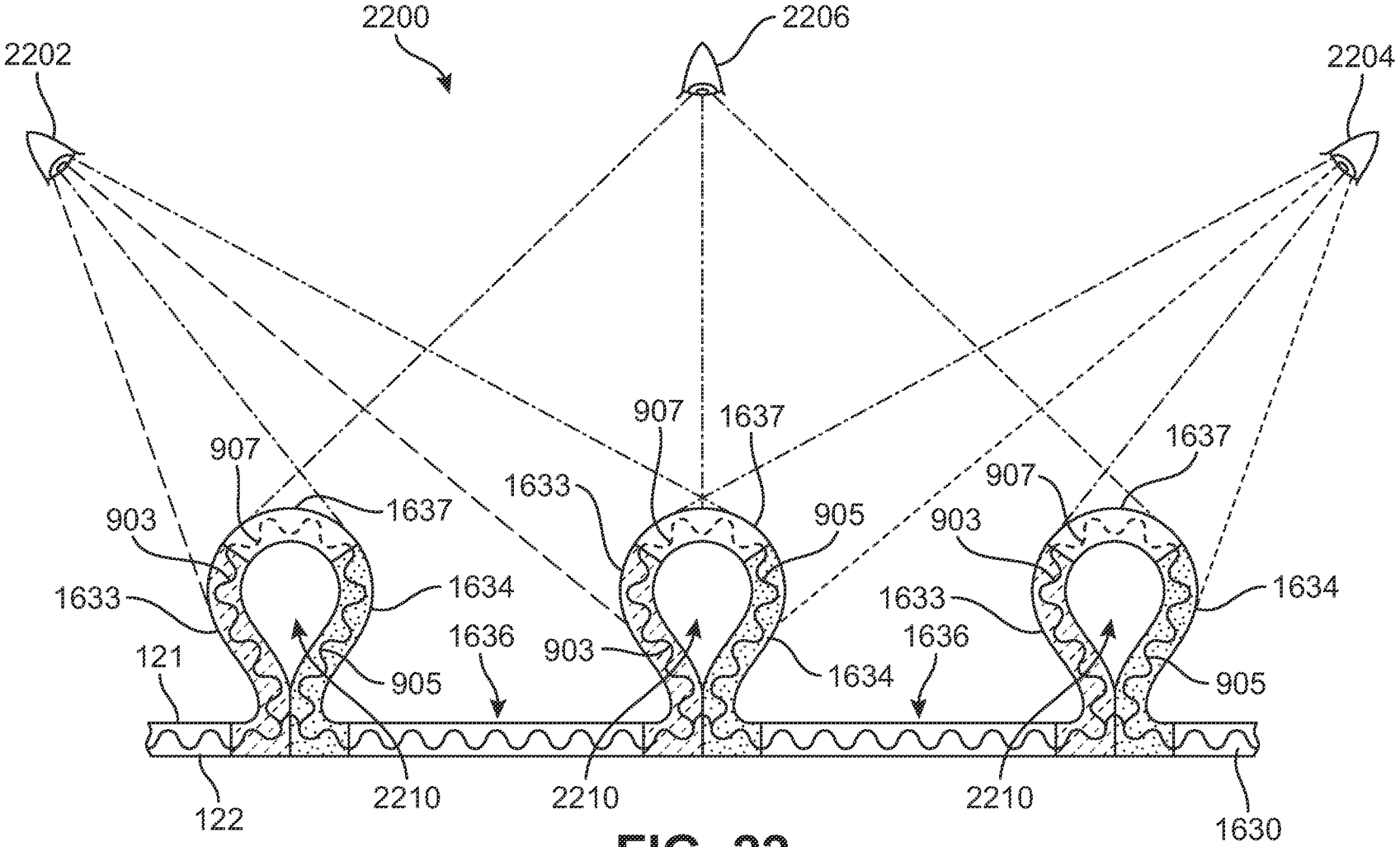
FIG. 22 is a representational view of a cross section of a knitted component incorporating lenticular knit structures having three colors.

FIG. 22 illustrates a representational view 2200 of a cross section of a portion of knitted component 1630 incorporating second lenticular knit structures 1638. For example, view 2200 may be a portion of knitted component associated with area 1602. In this embodiment, the portion of knitted component 1630 incorporates second lenticular knit structures 1638 with hollow unsecured areas 2210. It should be understood that second lenticular knit structures 1638 including inlaid tensile elements 724 may have a substantially similar structure with inlaid tensile element 724 being located with hollow unsecured areas 2210. As shown in this embodiment, each second lenticular knit structure 1638 includes first portion 1633 formed using second yarn 903 and second portion 1634 formed using third yarn 905. In addition, in contrast to first lenticular knit structure 1632, second lenticular knit structure 1638 further includes upper portion 1637 formed using fourth yarn 907.

In an exemplary embodiment, upper portion 1637 is located at the top of the tubular rib structure forming second lenticular knit structure 1638. In some embodiments, upper portion 1637 formed using fourth yarn 907 may be disposed between first portion 1633 and second portion 1634. That is, at least one course of first portion 1633 formed with second yarn 903 is interlooped with at least one course of upper portion 1637 formed with fourth yarn 907 and at least one course of second portion 1634 formed with third yarn 905 is also interlooped with at least one course of upper portion 1637 formed with fourth yarn 907. With this configuration, each of first portion 1633, upper portion 1637, and second portion 1634 are formed of unitary knit construction. Spaced between and separating each of second lenticular knit structures 1638 are base portion 1636 of knitted component 1630. Base portion 1636 is formed from first yarn 901, as described above, and is also formed of unitary knit construction with first portion 1633 and second portion 1634 on respective sides of second lenticular knit structure 1638.

The configuration of second lenticular knit structure 1638 including first portion 1633 formed by second yarn 903 on one side of the tubular rib structure and second portion 1634 formed by third yarn 905 on the opposite side of the tubular rib structure provides the color-shifting properties to knitted component 1630. In addition, upper portion 1637 of second lenticular knit structure 1638 formed by fourth yarn 907 on the top of the tubular rib structure may provide an additional visual effect to knitted component 1630. As noted above, in various embodiments, second yarn 903 and third yarn 905 may be different types that provide different visual effects. For example, in this embodiment, second yarn 903 may be associated with a first color and third yarn 905 may be associated with a second color that is different from the first. In other embodiments, however, second yarn 903 and third yarn 905 may be of types having different characteristics that may cause a visual color-shifting effect. In addition, fourth yarn 907 may be a different type from either or both of second yarn 903 and third yarn 905.

The color-shifting properties of knitted component 1630 provided by second lenticular knit structures 1638 will be described with reference to representational view 2200. In this embodiment, when knitted component 1630 is viewed from a first viewing angle 2202, first portion 1633 formed by second yarn 903 is primarily and substantially presented towards the viewer. Thus, from first viewing angle 2202, first portion 1633 of second lenticular knit structure 1638 may provide the primary overall visual effect of knitted component 1630 to the viewer. In this case, the characteristics associated with second yarn 903 forming first portion 1633 provide the visual effect, for example, the color of second yarn 903.

In contrast, when knitted component 1630 is viewed from a second viewing angle 2204 that is different from first viewing angle 2202, the viewer is presented with a different visual effect. In this embodiment, when knitted component 1630 is viewed from second viewing angle 2204, second portion 1634 formed by third yarn 905 is primarily and substantially presented towards the viewer. Thus, from second viewing angle 2204, second portion 1634 of second lenticular knit structure 1638 may provide the primary overall visual appearance of knitted component 1630 to the viewer. In this case, the characteristics associated with third yarn 905 forming second portion 1634 provide the visual effect, for example, the color of third yarn 905 that is different from the color of second yarn 903. As noted previously, in other embodiments, the varying visual effect provided between second yarn 903 and third yarn 905 may include other characteristics, including, but not limited to yarn type, denier, texture, or other properties that generate differing visual effects.

With this configuration of second lenticular knit structures 1638 on knitted component 1630, as well as the similar components forming first lenticular knit structures 1632, the color-shifting properties of upper 1620 and/or article 1600 may be provided so that a viewer observes a change in the visual effect of upper 1620 and/or article 1600 as the viewing angle changes, for example, as the viewing angle changes between first viewing angle 2202 and second viewing angle 2204. In contrast with first lenticular knit structures 1632 and lenticular knit structures 132 shown in representational view 1400, described above, second lenticular knit structures 1638 are configured to provide a third visual effect caused by upper portion 1637 formed using fourth yarn 907.

As shown in FIG. 22, the third visual effect generated by upper portion 1637 of second lenticular knit structures 1638 may be visible when viewing knitted component 1630 from a third viewing angle 2206 that is viewing the tops of second lenticular knit structures 1638 from an approximately vertical direction. However, because of the location of upper portion 1637 on the tops of second lenticular knit structures 1638, upper portion 1637 is also visible when viewing knitted component 1630 from either or both of first viewing angle 2202 and second viewing angle 2204. That is, the third visual effect provided by upper portion 1637 formed using fourth yarn 907 may remain substantially constant across multiple viewing angles. For example, the same visual effect generated by upper portion 1637 is visible from first viewing angle 2202, second viewing angle 2204, and third viewing angle 2206. With this configuration, second lenticular knit structure 1638 may provide a visual effect within area 1602 of knitted component 1630 that remains substantially unchanged through multiple viewing angles.

In addition, in some embodiments, base portion 1636 may be formed using first yarn 901 that is similar or different to one or more of second yarn 903, third yarn 905, and/or fourth yarn 907 to coordinate or contrast with first portion 1633, upper portion 1637, and/or second portion 1634 of second lenticular knit structure 1638 to further assist with the visual effects provided to knitted component 1630.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims. As used in the claims, "any of" when referencing the previous claims is intended to mean (i) any one claim, or (ii) any combination of two or more claims referenced.

We claim:

1. A knitted component having a front side and an opposite-facing back side, the knitted component comprising:

a base portion; and a raised knit structure extending away from the base portion, the raised knit structure disposed on the front side of the knitted component, wherein the raised knit structure comprises:

a first portion on a first side of the raised knit structure, wherein the first portion is formed at least partially with a first yarn associated with a first visual effect; and a second portion on a second side of the raised knit structure, wherein the second side is opposite the first side, and wherein the second portion is formed at least partially with a second yarn associated with a second visual effect, the second visual effect different from the first visual effect, wherein the first portion comprises a first quantity of knit courses, wherein the second portion comprises a second quantity of knit courses, and wherein the first quantity of knit courses is greater than the second quantity of knit courses.

2. The knitted component of claim 1, wherein the first visual effect is a first color, and wherein the second visual effect is a second color, the second color different from the first color.

3. The knitted component of claim 1, wherein the first portion excludes the second yarn.

4. The knitted component of claim 3, wherein the second portion excludes the first yarn.

5. The knitted component of claim 1, wherein from a first viewing angle, the first portion of the raised knit structure is visible and the second portion of the raised knit structure is at least partially blocked.

6. The knitted component of claim 5, wherein from a second viewing angle, the second portion of the raised knit structure is visible and the first portion of the raised knit structure is at least partially blocked.

7. The knitted component of claim 1, wherein the raised knit structure includes a third portion disposed between the first portion and the second portion, wherein the third portion is formed with a third yarn that is associated with a third visual effect.

8. The knitted component of claim 1, wherein the base portion is disposed between the raised knit structure and an adjacent second raised knit structure.

9. The knitted component of claim 1, wherein the raised knit structure is formed as a tubular knit structure.

10. The knitted component of claim 1, wherein the raised knit structure extends longitudinally along a course-wise direction of the knitted component.

11. A lenticular knit structure disposed on a front side of a knitted component, the lenticular knit structure comprising:

a first portion on a first side of the lenticular knit structure, wherein the first portion is formed at least partially with a first yarn associated with a first visual effect; and a second portion on a second side of the lenticular knit structure, wherein the second side is opposite the first side, the second portion formed at least partially with a second yarn associated with a second visual effect, the second visual effect different from the first visual effect, wherein the first portion comprises a first quantity of knit courses and the second portion comprises a second quantity of knit courses, and wherein the first quantity of knit courses is greater than the second quantity of knit courses forming the second portion.

12. The lenticular knit structure of claim 11, wherein the first visual effect is a first color, and wherein the second visual effect is a second color, the second color different from the first color.

13. The lenticular knit structure of claim 11, wherein the first portion excludes the second yarn.

14. The lenticular knit structure of claim 11, wherein from a first viewing angle, the first portion of the lenticular knit structure is visible and the second portion of the lenticular knit structure is at least partially blocked.

15. The lenticular knit structure of claim 14, wherein from a second viewing angle, the second portion of the lenticular knit structure is visible and the first portion of the lenticular knit structure is at least partially blocked.

16. The lenticular knit structure of claim 11, wherein the lenticular knit structure includes a third portion disposed between the first portion and the second portion, wherein the third portion is formed with a third yarn that is associated with a third visual effect.

17. The lenticular knit structure of claim 11, wherein the front side of the knitted component forms an outer surface of an upper for an article of footwear.

18. A method, comprising:

knitting a base portion of a knitted component, the knitted component having a front side and an opposite-facing back side; and knitting a raised knit structure that extends from the base portion and is disposed on the front side of the knitted component, wherein the raised knit structure comprises:

a first portion on a first side of the raised knit structure, wherein the first portion is formed at least partially with a first yarn associated with a first visual effect; and a second portion on a second side of the raised knit structure, wherein the second side is opposite the first side, the second portion formed at least partially with a second yarn associated with a second visual effect, the second visual effect different from the first visual effect, wherein the first portion comprises a first quantity of knit courses and the second portion comprises a second quantity of knit courses, and wherein the first quantity of knit courses is greater than the second quantity of knit courses forming the second portion.

19. The method of claim 18, wherein the first visual effect is a first color, and wherein the second visual effect is a second color, the second color different from the first color.

20. The method of claim 18, wherein the first portion excludes the second yarn, and wherein the second portion excludes the first yarn.

* * * * *